US011843201B2

(12) United States Patent
Wu et al.

(10) Patent No.: US 11,843,201 B2
(45) Date of Patent: Dec. 12, 2023

(54) HIGH SPEED ELECTRICAL CONNECTOR WITH GROUNDED SHIELDING SURROUNDING SIGNAL CONTACTS

(71) Applicant: Dongguan Luxshare Technologies Co., Ltd, Dongguan (CN)

(72) Inventors: XiaoPing Wu, Dongguan (CN); Bin Huang, Dongguan (CN)

(73) Assignee: Dongguan Luxshare Technologies Co., Ltd, Dongguan (CN)

( * ) Notice: Subject to any disclaimer, the term of this patent is extended or adjusted under 35 U.S.C. 154(b) by 241 days.

(21) Appl. No.: 17/512,061

(22) Filed: Oct. 27, 2021

(65) Prior Publication Data

US 2022/0344872 A1 Oct. 27, 2022

(30) Foreign Application Priority Data

Apr. 27, 2021 (CN) ..... 202110459454.5

(51) Int. Cl.
*H01R 13/6581* (2011.01)
*H01R 13/6471* (2011.01)
(Continued)

(52) U.S. Cl.
CPC ..... *H01R 13/6581* (2013.01); *H01R 13/6471* (2013.01); *H01R 13/652* (2013.01); *H01R 13/6585* (2013.01); *H01R 13/6586* (2013.01); *H01R 13/6597* (2013.01); *H01R 13/405* (2013.01); *H01R 13/516* (2013.01);
(Continued)

(58) Field of Classification Search
CPC ..... H01R 13/6581; H01R 13/6471; H01R 13/652; H01R 13/6585; H01R 13/6586; H01R 13/6597; H01R 13/405; H01R 13/516; H01R 13/646; H01R 13/6461;
(Continued)

(56) References Cited

U.S. PATENT DOCUMENTS 10,403,565 B1 * 9/2019 Henry ..... H01R 13/6596

FOREIGN PATENT DOCUMENTS

CN 203445352 U 2/2014
CN 105428860 A 3/2016
(Continued)

*Primary Examiner* — Abdullah A Riyami
*Assistant Examiner* — Justin M Kratt
(74) *Attorney, Agent, or Firm* — Birch, Stewart, Kolasch & Birch, LLP

(57) ABSTRACT

An electrical connector, comprising a housing, a first upper terminal module, a second upper terminal module, a first lower terminal module, and a second lower terminal module. The first upper terminal module, the second upper terminal module, the first lower terminal module, and the second lower terminal module respectively comprise an insulating body, a plurality of signal terminals, a plurality of ground terminals, and an electromagnetic shielding member. The plurality of signal terminals and the plurality of ground terminals are disposed in the insulating body. A plurality of signal terminals are disposed between two adjacent ground terminals. The plurality of first ground terminals respectively comprise a plurality of flat contacting parts exposed from the insulating body, where the heights of the plurality of flat contacting parts of respective ground terminals are different. The electromagnetic shielding member is disposed on the insulating body.

27 Claims, 15 Drawing Sheets

(51) Int. Cl.

| | |
|---|---|
| ***H01R 13/6585*** | (2011.01) |
| ***H01R 13/6586*** | (2011.01) |
| ***H01R 13/6597*** | (2011.01) |
| ***H01R 13/652*** | (2006.01) |
| *H01R 13/6595* | (2011.01) |
| *H01R 13/6591* | (2011.01) |
| *H01R 13/6594* | (2011.01) |
| *H01R 13/658* | (2011.01) |
| *H01R 13/6461* | (2011.01) |
| *H01R 13/646* | (2011.01) |
| *H01R 13/648* | (2006.01) |
| *H01R 13/405* | (2006.01) |
| *H01R 13/516* | (2006.01) |

(52) U.S. Cl.
CPC ..... *H01R 13/646* (2013.01); *H01R 13/648* (2013.01); *H01R 13/6461* (2013.01); *H01R 13/658* (2013.01); *H01R 13/6591* (2013.01); *H01R 13/6594* (2013.01); *H01R 13/6595* (2013.01)

(58) Field of Classification Search
CPC ..... H01R 13/648; H01R 13/658; H01R 13/6591; H01R 13/6594; H01R 13/6595
See application file for complete search history.

(56) References Cited

FOREIGN PATENT DOCUMENTS

| | | | |
|---|---|---|---|
| CN | 204966857 | U | 1/2018 |
| CN | 107994366 | A | 5/2018 |
| CN | 108808312 | A | 11/2018 |
| CN | 109216980 | A | 1/2019 |
| CN | 208580888 | U | 3/2019 |
| CN | 109742593 | A | 5/2019 |
| CN | 212810743 | U | 3/2021 |
| JP | 2000-260531 | A | 9/2000 |
| TW | I635657 | B | 9/2018 |

* cited by examiner

HIGH SPEED ELECTRICAL CONNECTOR WITH GROUNDED SHIELDING SURROUNDING SIGNAL CONTACTS

CROSS-REFERENCE TO RELATED APPLICATION

This application claims the priority benefit of Chinese Patent Application Serial Number 202110459454.5, filed on Apr. 27, 2021, the full disclosure of which is incorporated herein by reference.

BACKGROUND

Technical Field

The present disclosure relates to the technical field of connector, particularly to an electrical connector.

Related Art

High speed connectors are a type of connector commonly used in large scale communication equipment, ultrahigh performance servers, supercomputers, industrial computers, and high-end storage devices. In conventional high speed connectors, multiple signal terminal peripheral devices that transmit signals are prone to produce electromagnetic interference such as crosstalk and noise. Conductive plastics can be provided among multiple signal terminals for electromagnetic shielding. However, since the size of area of the signal terminal that conductive plastics cover is quite limited, the signal stability and high frequency transmission performance of high speed connectors do not satisfy expectations. In this way, the applying of conductive plastic would increase the overall manufacturing cost and thereby increase the size of high speed connectors.

SUMMARY

The embodiments of the present disclosure provide an electrical connector intended to solve the problem that conventional high speed connectors are prone to produce electromagnetic interference during the signal transmission process, which affects the signal transmission performance of high speed connectors. Using conductive plastic as an electromagnetic shielding member for conventional connectors would increase the overall size and production cost, while the signal transmission performance cannot be effectively improved.

The present disclosure provides an electrical connector, comprising a housing, a first upper terminal module, a first lower terminal module, a second upper terminal module, and a second lower terminal module. The housing comprises an accommodating groove. The first upper terminal module is disposed in the accommodating groove. The second upper terminal module is disposed in the accommodating groove. The second upper terminal module is disposed at one side of the first upper terminal module. The first lower terminal module is disposed in the accommodating groove. The first lower terminal module is disposed at one side of the second upper terminal module. The second lower terminal module is disposed in the accommodating groove. The second lower terminal module is disposed between the first lower terminal module and the second upper terminal module. The first upper terminal module, the second upper terminal module, the first lower terminal module, and the second lower terminal module are stacked along a first direction. Wherein the first upper terminal module, the second upper terminal module, the first lower terminal module, and the second lower terminal module respectively comprise an insulating body, a plurality of signal terminals, a plurality of ground terminals, and an electromagnetic shielding member. The plurality of signal terminals and the plurality of ground terminals are disposed in the insulating body. At least one of the signal terminals is disposed between two adjacent ground terminals. The plurality of signal terminals comprise a plurality of first signal terminals. The plurality of ground terminals comprise a plurality of first ground terminals. Each of the plurality of first ground terminals respectively comprises a plurality of flat contacting parts exposed from the insulating body. The heights of the plurality of flat contacting parts on each of the ground terminals are different. The electromagnetic shielding member is disposed on a surface of the insulating body in the first direction. The electromagnetic shielding member comprises a plurality of shielding parts and a plurality of grounding parts. Two opposite sides of the plurality of shielding parts respectively comprise the plurality of grounding parts. The plurality of grounding parts are respectively in contact with the plurality of flat contacting parts of the corresponding first ground terminal. The plurality of shielding parts respectively cover a part of the plurality of first signal terminals.

In the embodiments of the present disclosure, an electromagnetic shielding member is configured to contact one ground terminal in multiple, separate contact areas, so that the electromagnetic shielding member can be disposed along the contour of a bent terminal. In this way, not only the overall manufacturing cost can be reduced, but the size of the electrical connector would not be increased, and the area of the electromagnetic shielding member covering the plurality of first signal terminals (high speed signal terminals) can further be increased. Thus, the signal transmission performance of the electrical connector can be effectively improved to a rate of 40 Gbps or even faster.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
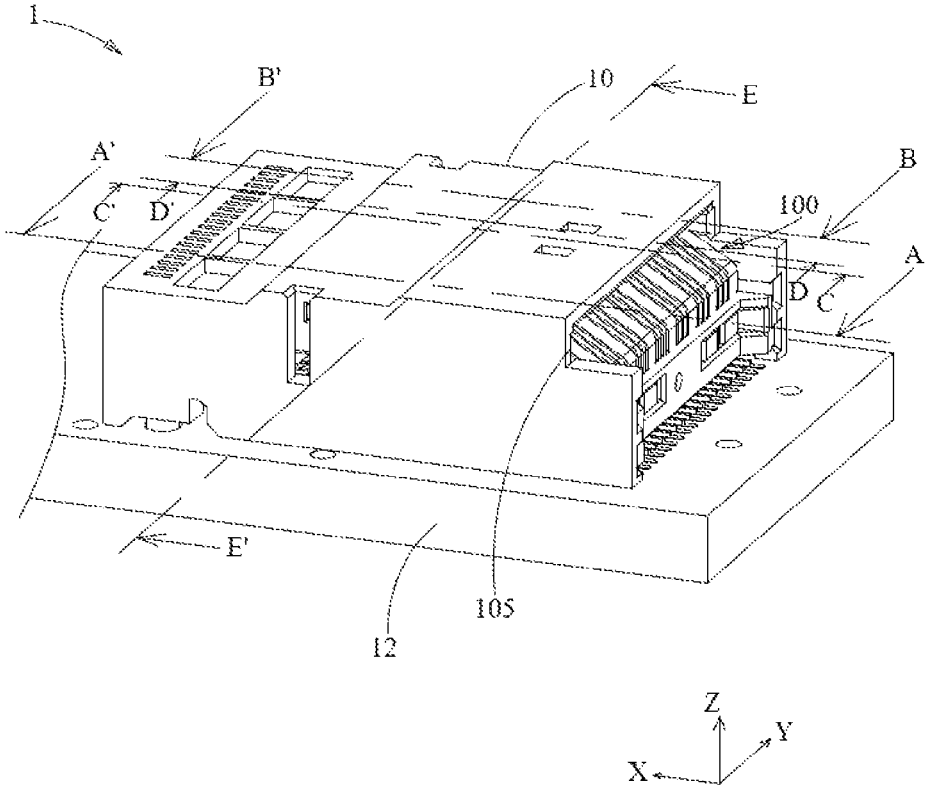
FIG. 1 is a perspective view of an electrical connector of an embodiment of the present disclosure.
Figure 2:
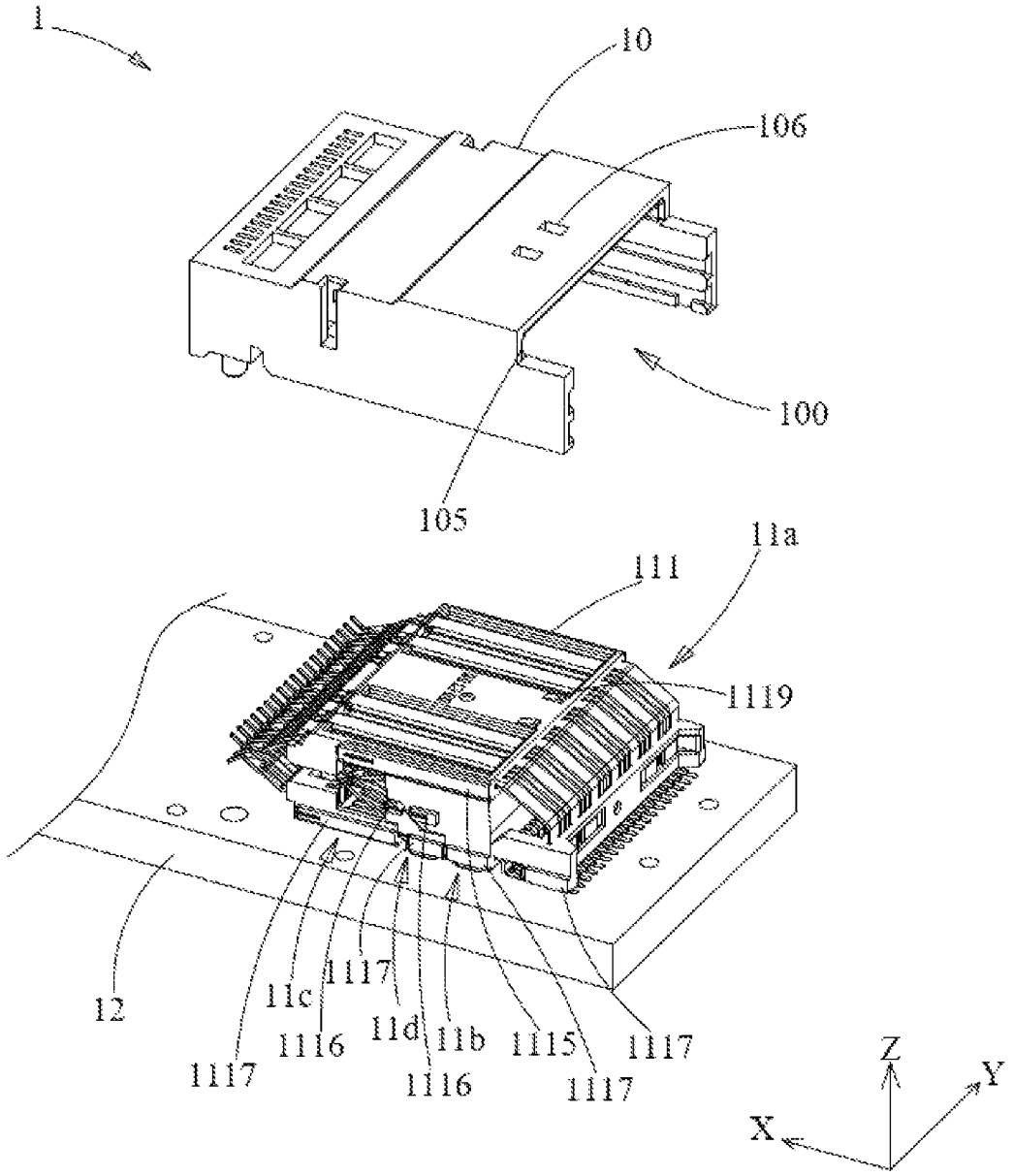
FIG. 2 is a first exploded view of the electrical connector of an embodiment of the present disclosure.
Figure 3:
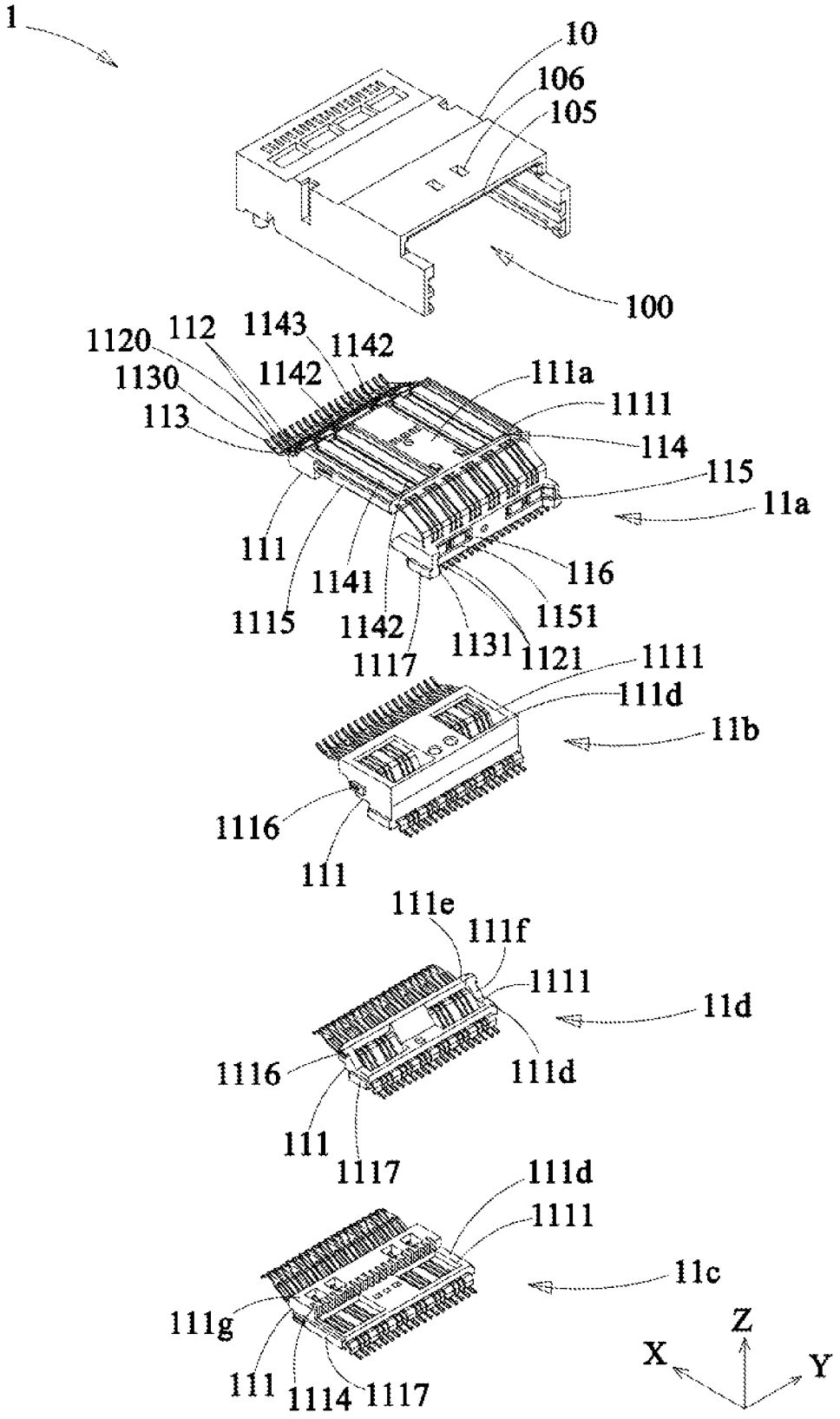
FIG. 3 is a second exploded view of the electrical connector of an embodiment of the present disclosure.
Figure 4:
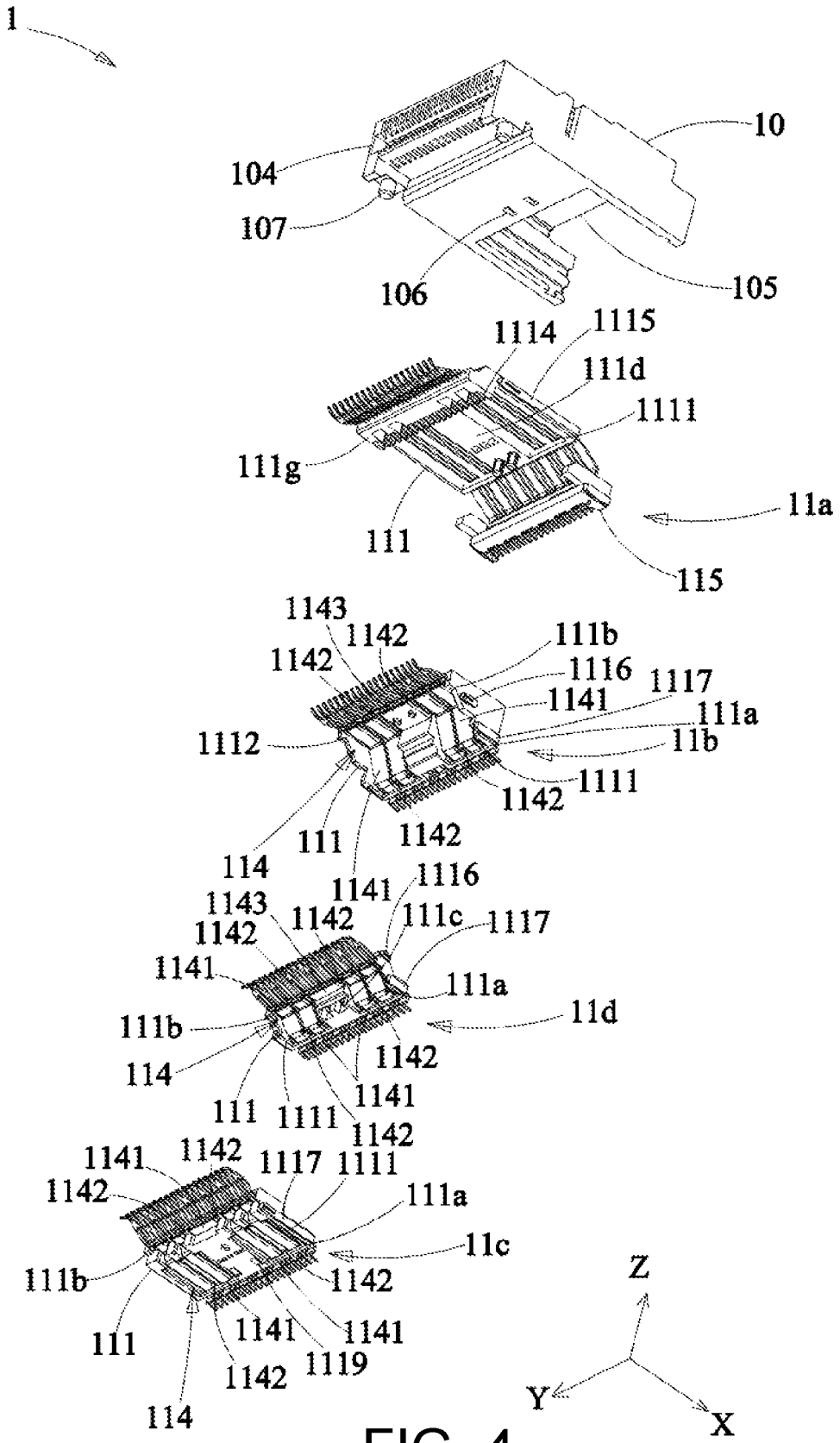
FIG. 4 is a third exploded view of the electrical connector of an embodiment of the present disclosure.
Figure 5:
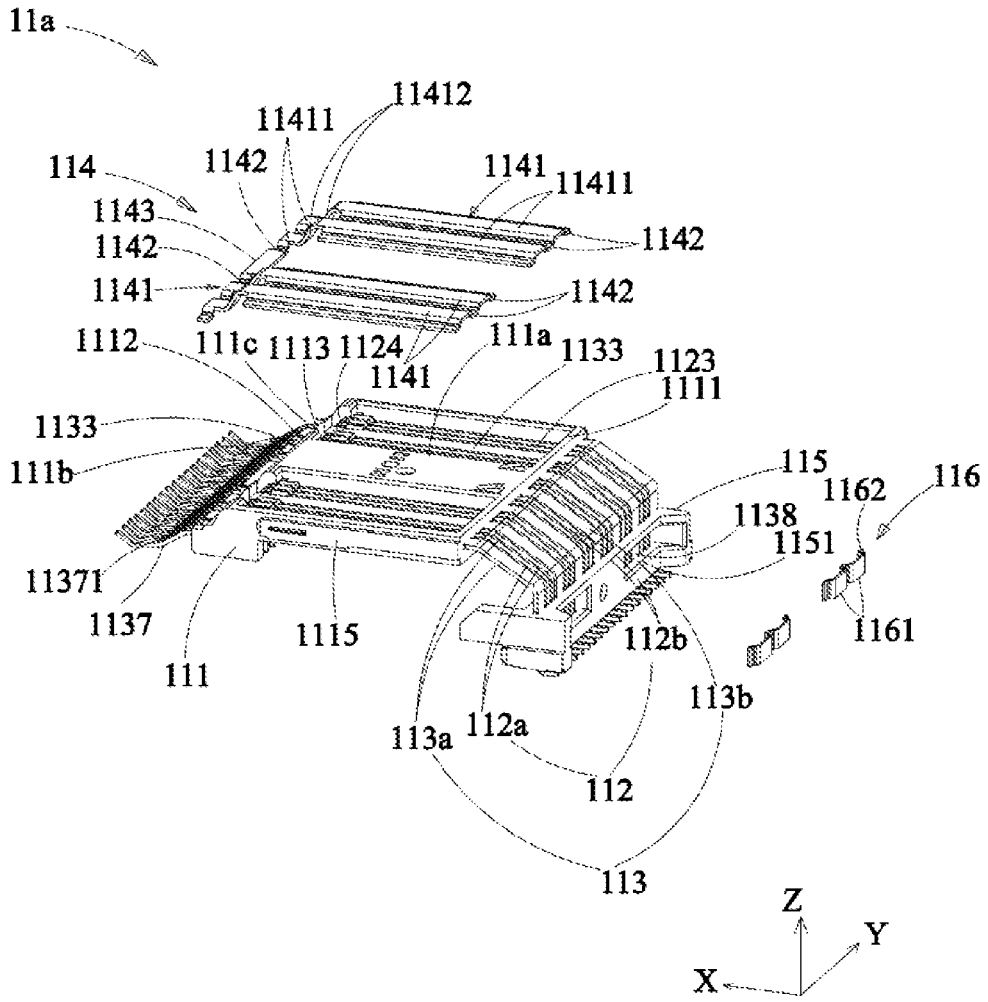
FIG. 5 is an exploded view of a first upper terminal module of an embodiment of the present disclosure.
Figure 6:
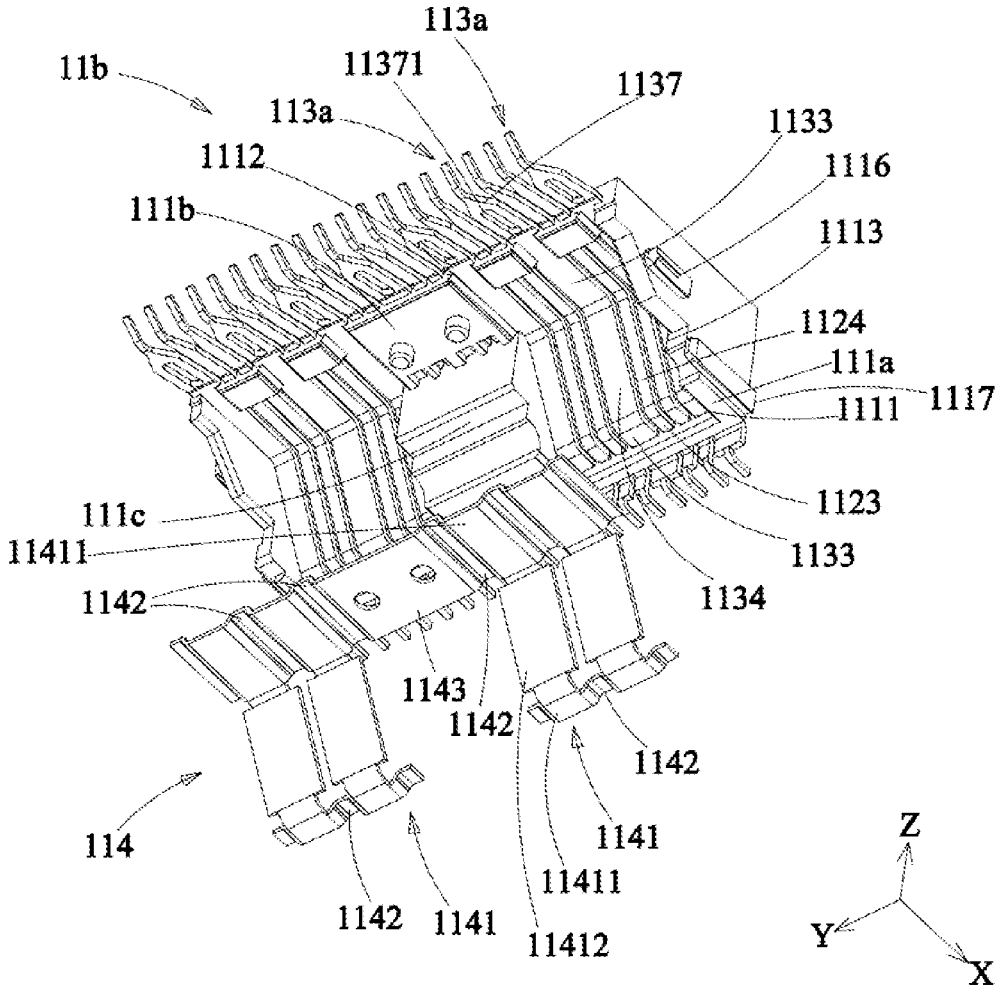
FIG. 6 is an exploded view of a second upper terminal module of an embodiment of the present disclosure.
Figure 7:
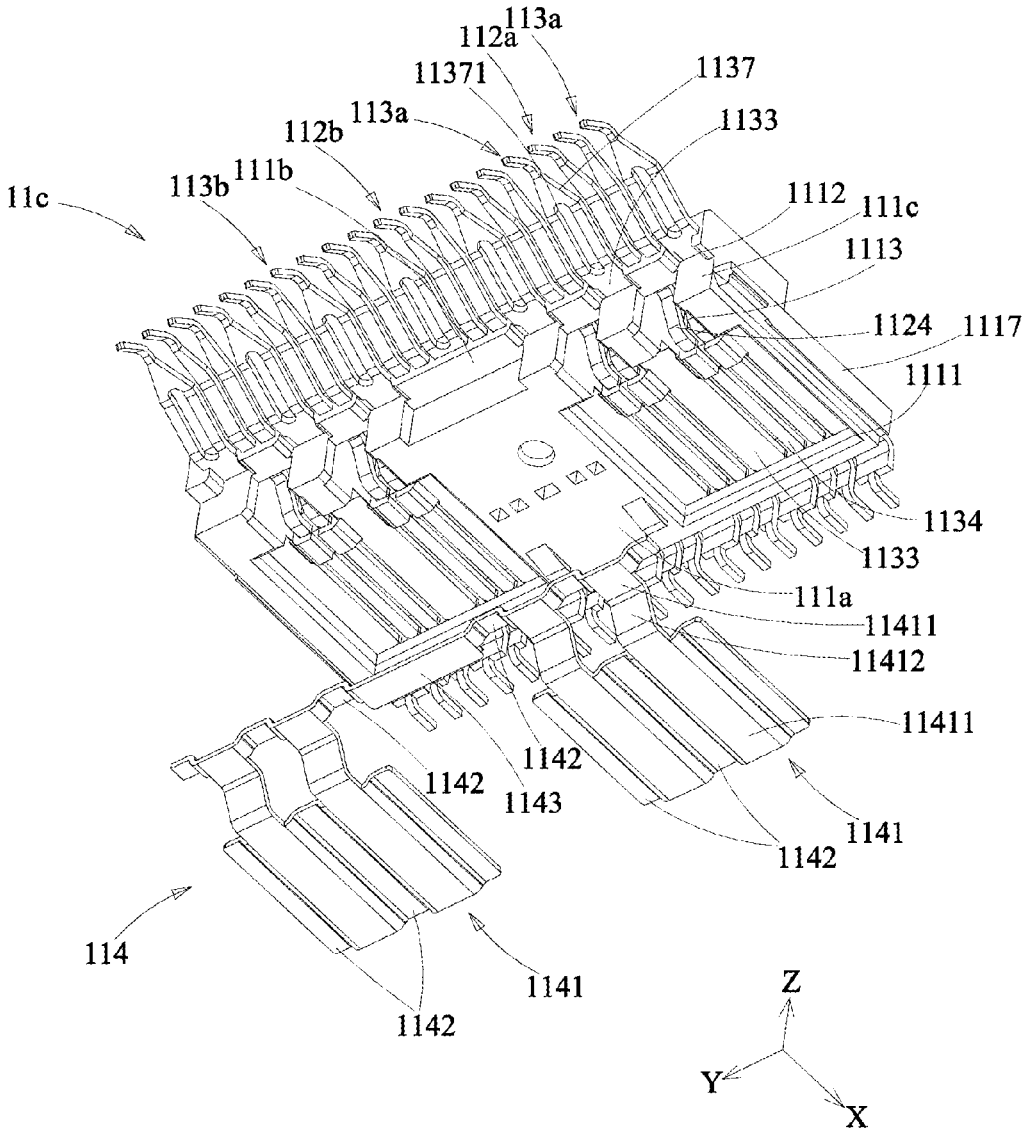
FIG. 7 is an exploded view of a first lower terminal module of an embodiment of the present disclosure.
Figure 8:
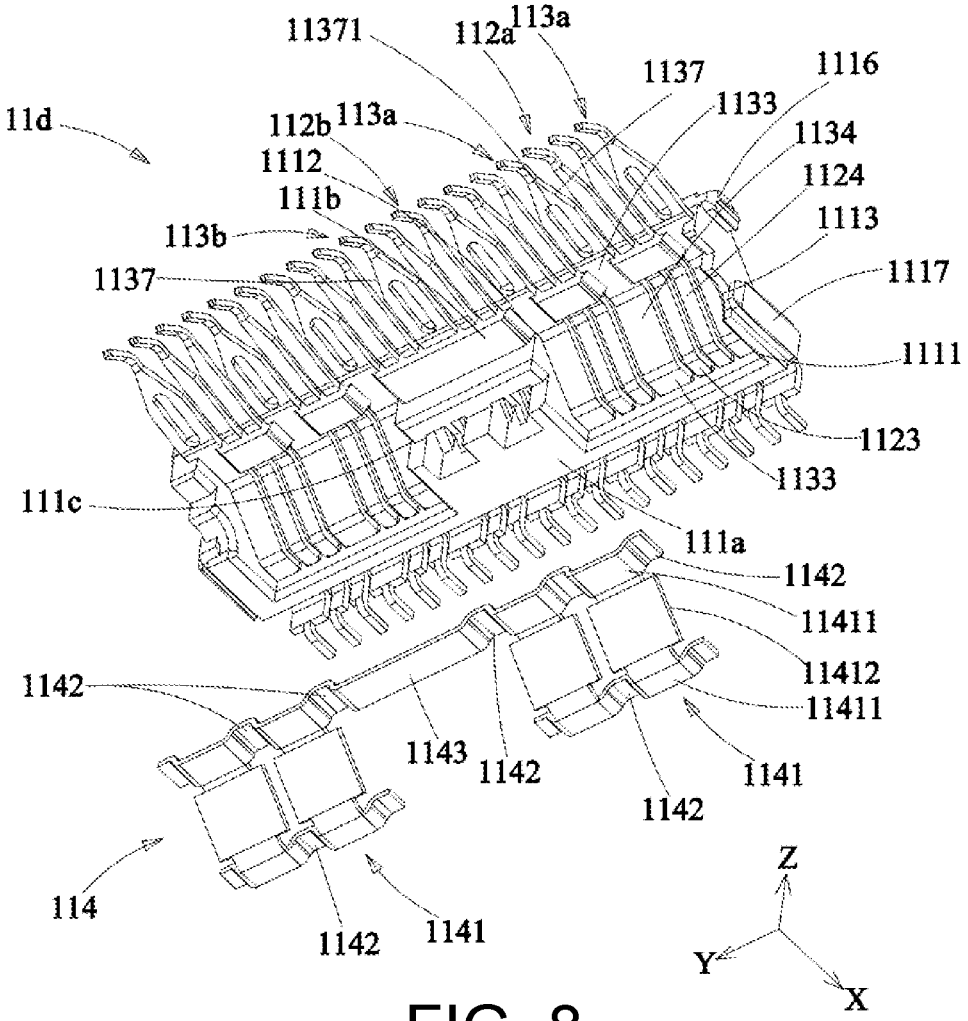
FIG. 8 is an exploded view of a second lower terminal module of an embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but not in function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

FIG. 1 to FIG. 4 are perspective view, first exploded view, second exploded view, and third exploded view of an electrical connector of an embodiment of the present disclosure. As shown in the figures, in this embodiment, the electrical connector 1 comprises a housing 10, a first upper terminal module 11*a*, a second upper terminal module 11*b*, a first lower terminal module 11*c*, and a second lower terminal module 11*d*. The first upper terminal module 11*a*, the second upper terminal module 11*b*, the first lower terminal module 11*c*, and the second lower terminal module 11*d* are stacked in a first direction Z. The second upper terminal module 11*b* and the second lower terminal module 11*d* are disposed between the first upper terminal module 11*a* and the first lower terminal module 11*c*. The housing 10 comprises an accommodating groove 100 extending in a second direction X orthogonal to the first direction Z. The stacked first upper terminal module 11*a*, second upper terminal module 11*b*, second lower terminal module 11*d*, and first lower terminal module 11*c* are disposed in the accommodating groove 100. In other words, the second upper terminal module 11*b* is disposed at one side of the first upper terminal module 11*a*, the first lower terminal module 11*c* is disposed at one side of the second upper terminal module 11*b*, and the second lower terminal module 11*d* is disposed between the second upper terminal module 11*b* and the first lower terminal module 11*c*.

FIG. 5 to FIG. 8 are exploded views of a first upper terminal module, second upper terminal module, first lower terminal module, and second lower terminal module of an embodiment of the present disclosure, respectively. As shown in the figures, in this embodiment, the first upper terminal module 11*a*, the second upper terminal module 11*b*, the first lower terminal module 11*c*, and the second lower terminal module 11*d* respectively comprise an insulating body 111, a plurality of signal terminals 112, a plurality of ground terminals 113, and an electromagnetic shielding member 114. The plurality of signal terminals 112 and the plurality of ground terminals 113 are disposed in the insulating body 111. The plurality of signal terminals 112 respectively comprise a signal plugging end 1120 and a signal connecting end 1121. The plurality of ground terminals 113 respectively comprise a ground plugging end 1130 and a ground connecting end 1131. The signal plugging ends 1120 and the signal connecting ends 1121 of the plurality of signal terminals 112 and the ground plugging ends 1130 and the ground connecting ends 1131 of the plurality of ground terminals 113 respectively protrude from a side edge of the insulating body 111 in the second direction X orthogonal to the first direction Z. The signal connecting ends 1121 of the plurality of signal terminals 112 and the ground connecting ends 1131 of the plurality of ground terminals 113 respectively extend along the first direction Z. At least one signal terminal 112 is disposed between two adjacent ground terminals 113. In this embodiment, two signal terminals 112 are disposed between two adjacent ground terminals 113.

Figure 9:
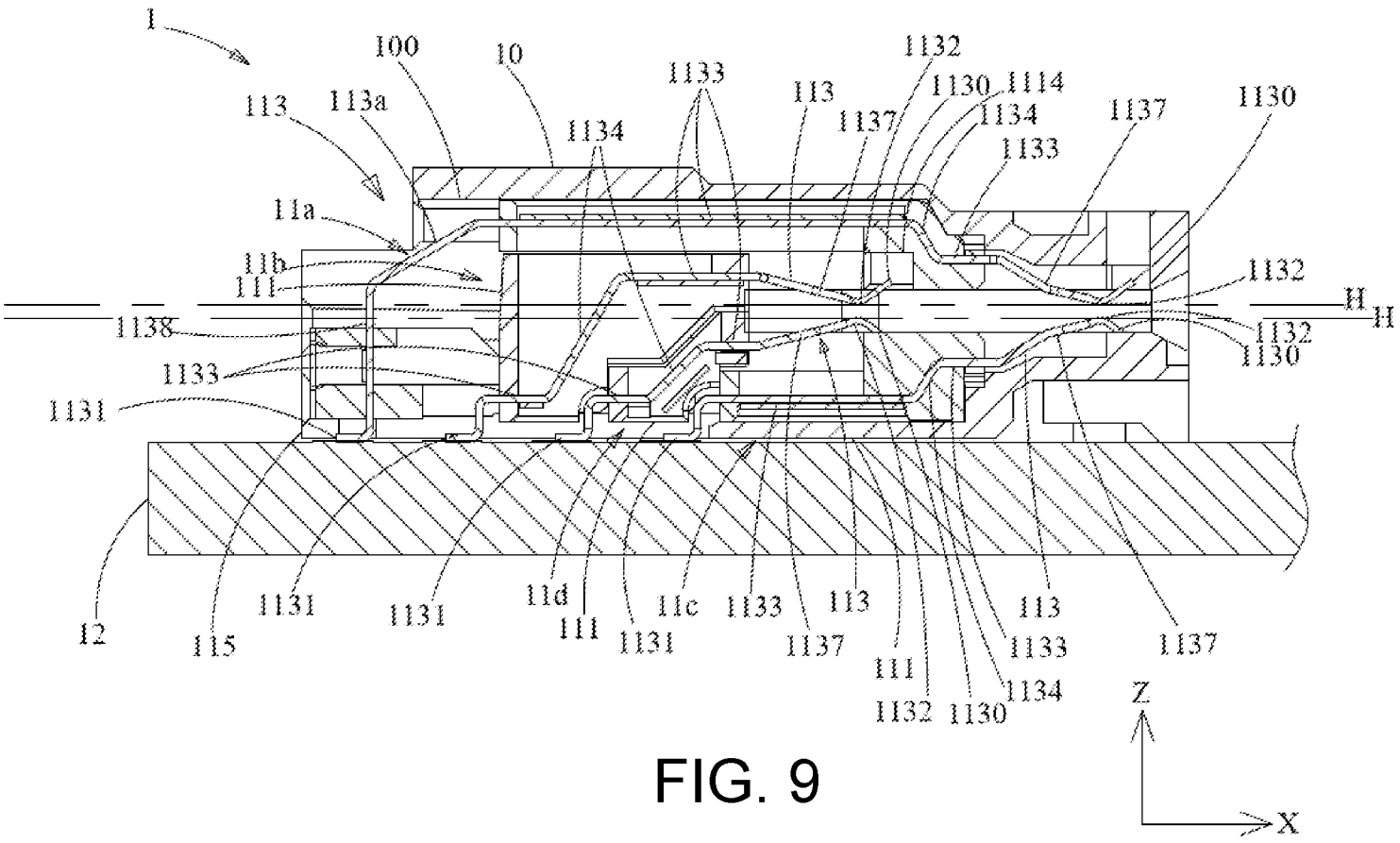
FIG. 9 is a cross-sectional view along line A-A' of FIG. 1.
Figure 10:
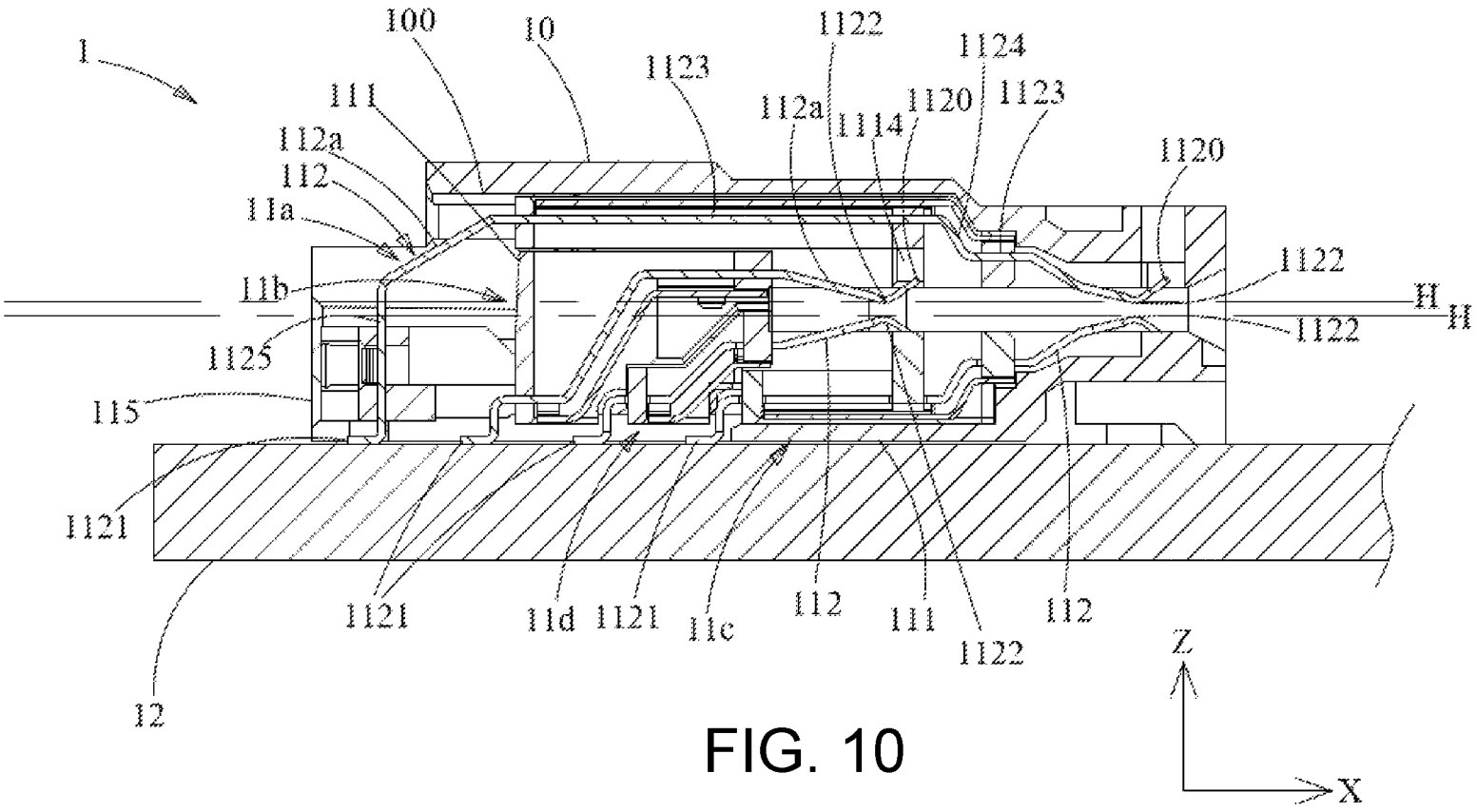
FIG. 10 is a cross-sectional view along line B-B' of FIG. 1.

FIG. 9 is a cross-sectional view along line A-A' of FIG. 1. FIG. 10 is a cross-sectional view along line B-B' of FIG. 1. As shown in the figures, the signal plugging ends 1120 of the plurality of signal terminals 112 and the ground plugging ends 1130 of the plurality of ground terminals 113 of the first upper terminal module 11*a* is farther than the signal plugging ends 1120 of the plurality of signal terminals 112 and the ground plugging ends 1130 of the plurality of ground terminals 113 of the second upper terminal module 11*b* away from the insulating body 111 of the second upper terminal module 11*b*. The signal plugging ends 1120 of the plurality of signal terminals 112 and the ground plugging ends 1130 of the plurality of ground terminals 113 of the first lower terminal module 11*c* is farther than the signal plugging ends 1120 of the plurality of signal terminals 112 and the ground plugging ends 1130 of the plurality of ground terminals 113 of the second lower terminal module 11*d* away from the insulating body 111 of the second lower terminal module 11*d*. The signal plugging ends 1120 of the plurality of signal terminals 112 and the ground plugging ends 1130 of the plurality of ground terminals 113 of the first upper terminal module 11*a* are opposite to the signal plugging ends 1120 of the plurality of signal terminals 112 and the ground plugging ends 1130 of the plurality of ground terminals 113 of the first lower terminal module 11*c*. The signal plugging ends 1120 of the plurality of signal terminals 112 and the ground plugging ends 1130 of the plurality of ground terminals 113 of the second upper terminal module 11*b* are opposite to the signal plugging ends 1120 of the plurality of signal terminals 112 and the ground plugging ends 1130 of the plurality of ground terminals 113 of the second lower terminal module 11*d*.

The signal connecting ends 1121 of a plurality of signal terminals 112 of the first upper terminal module 11*a* are farther than the signal connecting ends 1121 of the plurality of signal terminals 112 of the second upper terminal module 11*b* away from the insulating body 111 of the second upper terminal module 11*b*. The signal connecting ends 1121 of the plurality of signal terminals 112 of the second upper terminal module 11*b* are farther than the signal connecting ends 1121 of the plurality of signal terminals 112 of the second lower terminal module 11*d* away from the insulating body 111 of the second lower terminal module 11*d*. The signal connecting ends 1121 of the plurality of signal terminals 112 of the second lower terminal module 11*d* are farther than the signal connecting ends 1121 of the plurality of signal terminals 112 of the first lower terminal module 11*c* away from the insulating body 111 of the first lower terminal module 11*c*. The ground connecting ends 1131 of the plurality of ground terminals 113 of the first upper terminal module 11*a* are farther than the ground connecting ends 1131 of the plurality of ground terminals 113 of the second upper terminal module 11*b* away from the insulating body 111 of the second upper terminal module 11*b*. The ground connecting ends 1131 of the plurality of ground terminals 113 of the second upper terminal module 11*b* are farther than the ground connecting ends 1131 of the plurality of ground terminals 113 of the second lower terminal module 11*d* away from the insulating body 111 of the second lower terminal module 11*d*. The ground connecting ends 1131 of the plurality of ground terminals 113 of the second lower terminal module 11*d* are farther than the ground connecting ends 1131 of the plurality of ground terminals 113 of the first lower terminal module 11*c* away from the insulating body 111 of the first lower terminal module 11*c*.

In other words, the signal connecting ends 1121 of the plurality of signal terminals 112 of the first lower terminal module 11*c*, the signal connecting ends 1121 of the plurality of signal terminals 112 of the second lower terminal module 11*d*, the signal connecting ends 1121 of the plurality of signal terminals 112 of the second upper terminal module 11*b*, and the signal connecting ends 1121 of the plurality of signal terminals 112 of the first upper terminal module 11*a* are arranged along the second direction X in order. The ground connecting ends 1131 of the plurality of ground terminals 113 of the first lower terminal module 11*c*, the ground connecting ends 1131 of the plurality of ground terminals 113 of the second lower terminal module 11*d*, the ground connecting ends 1131 of the plurality of ground terminals 113 of the second upper terminal module 11*b*, and the ground connecting ends 1131 of the plurality of ground terminals 113 of the first upper terminal module 11*a* are arranged along the second direction X in order.

In this embodiment, the signal plugging ends 1120 of the plurality of signal terminals 112 respectively comprise a signal contacting bump 1122, and the ground plugging ends 1130 of the plurality of ground terminals 113 respectively comprise a ground contacting bump 1132. The protruding direction of the signal contacting bumps 1122 of the plurality of signal terminals 112 and the ground contacting bumps 1132 of the plurality of ground terminals 113 of the first upper terminal module 11*a* and the signal contacting bumps 1122 of the plurality of signal terminals 112 and the ground contacting bumps 1132 of the plurality of ground terminals 113 of the second upper terminal module 11*b* is opposite to the protruding direction of the signal contacting bumps 1122 of the plurality of signal terminals 112 and the ground contacting bumps 1132 of the plurality of ground terminals 113 of the first lower terminal module 11*c* and the signal contacting bumps 1122 of the plurality of signal terminals 112 and the ground contacting bumps 1132 of the plurality of ground terminals 113 of the second lower terminal module 11*d*.

The signal contacting bumps 1122 of the plurality of signal terminals 112 of the first upper terminal module 11*a* and the signal contacting bumps 1122 of the plurality of signal terminals 112 of the second upper terminal module 11*b* are disposed on a horizontal plane H orthogonal to the first direction Z. The ground contacting bumps 1132 of the plurality of ground terminals 113 of the first upper terminal module 11*a* and the ground contacting bumps 1132 of the plurality of ground terminals 113 of the second upper terminal module 11*b* are disposed on the horizontal plane H orthogonal to the first direction Z. Similarly, the signal contacting bumps 1122 of the plurality of signal terminals 112 and the ground contacting bumps 1132 of the plurality of ground terminals 113 of the first lower terminal module 11*c* and the signal contacting bumps 1122 of the plurality of signal terminals 112 and the ground contacting bumps 1132 of the plurality of ground terminals 113 of the second lower terminal module 11*d* are disposed on a horizontal plane orthogonal to the first direction Z.

The structural configuration of the first upper terminal module 11*a*, the second upper terminal module 11*b*, the first lower terminal module 11*c*, and the second lower terminal module 11*d* would be described below. The plurality of signal terminals 112 comprise a plurality of first signal terminals 112*a* and a plurality of second signal terminals 112*b*. In this embodiment, the first signal terminal 112*a* is a high speed signal terminal, and the second signal terminal 112*b* is a low speed signal terminal. The plurality of ground terminals 113 comprise a plurality of first ground terminals 113*a* and a plurality of second ground terminals 113*b*. In this embodiment, two first signal terminals 112*a* are disposed between two adjacent first ground terminals 113*a*, and two second signal terminals 112*b* are disposed between two adjacent second ground terminals 113*b*. Each of the first ground terminals 113*a* comprises a plurality of flat contacting parts 1133, which are parallel to the horizontal plane H orthogonal to the first direction Z. The heights of the plurality of flat contacting parts 1133 on each of the first ground terminals 113*a* are different. The plurality of flat contacting parts 1133 are exposed from a surface of the insulating body 111 in the first direction Z. Specifically, the insulating body 111 comprises a plurality of first accommodating recesses 1111, a plurality of second accommodating recesses 1112, and a plurality of third accommodating recesses 1113. The plurality of first accommodating recesses 1111 and the plurality of second accommodating recesses 1112 are respectively formed on a first surface 111*a* and a second surface 111*b* of the insulating body 111 in the first direction Z, where the first surface 111*a* is parallel to the second surface 111. The plurality of third accommodating recesses 1113 are formed on a first connecting surface 111*c* between the first surface 111*a* and the second surface 111*b*. The plurality of first accommodating recesses 1111 are respectively communicating with the plurality of third accommodating recesses 1113. The plurality of first accommodating recesses 1111 could penetrate a third surface 111*d* of the insulating body 111 in the first direction Z, where the third surface 111*d* is opposite to the first surface 111*a*. The plurality of flat contacting parts 1133 are respectively exposed from the plurality of first accommodating recesses 1111 and from the plurality of second accommodating recesses 1112.

In this embodiment, each of the first ground terminals 113*a* comprises two flat contacting parts 1133 of which the heights are different. Each of the first ground terminals 113*a* comprises an inclined connecting part 1134. Two ends of the inclined connecting part 1134 are respectively connected with two adjacent flat contacting parts 1133. The inclined connecting part 1134 of each of the first ground terminals 113*a* is exposed from the corresponding third accommodating recess 1113.

Figure 11:
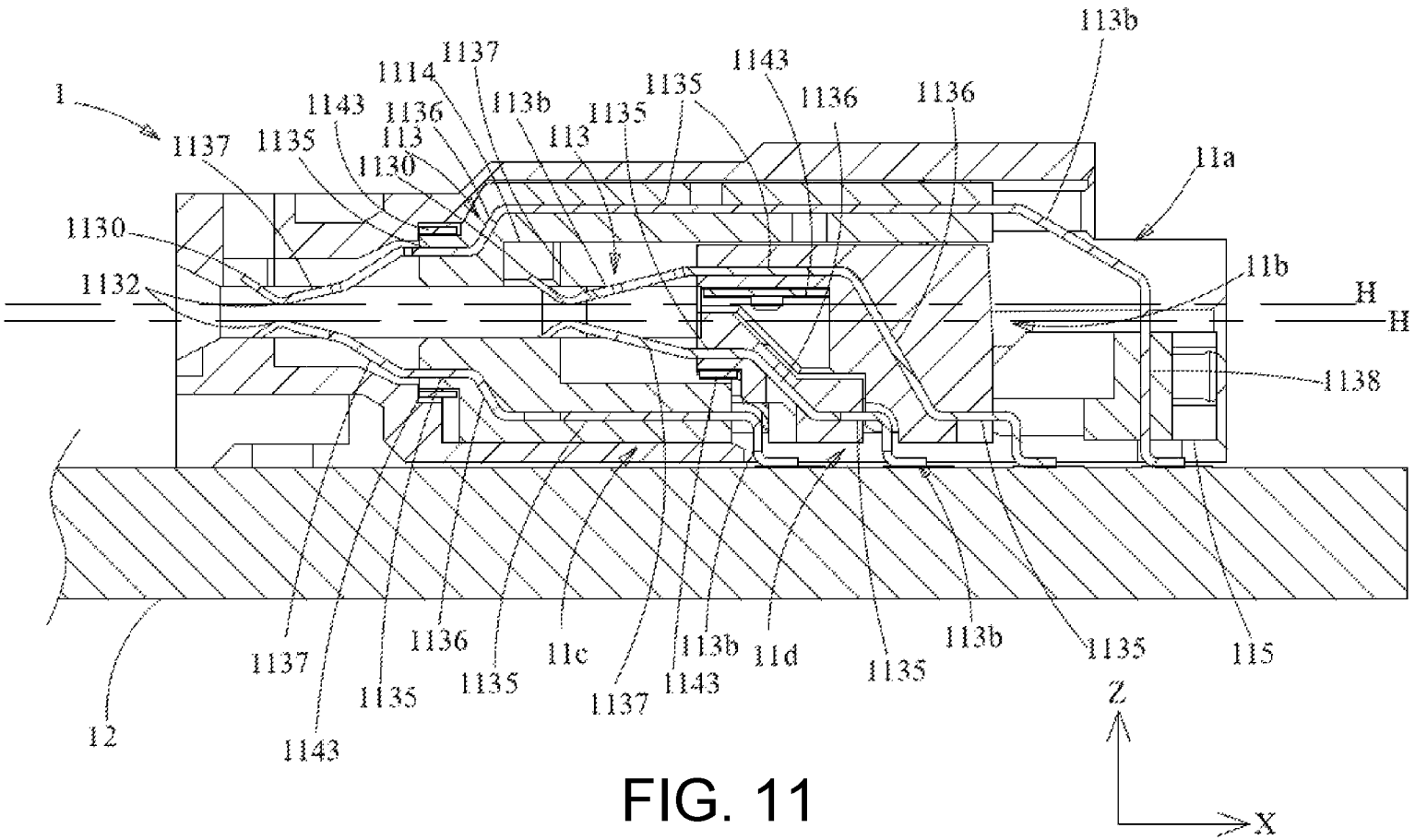
FIG. 11 is a cross-sectional view along line C-C' of FIG. 1.
Figure 12:
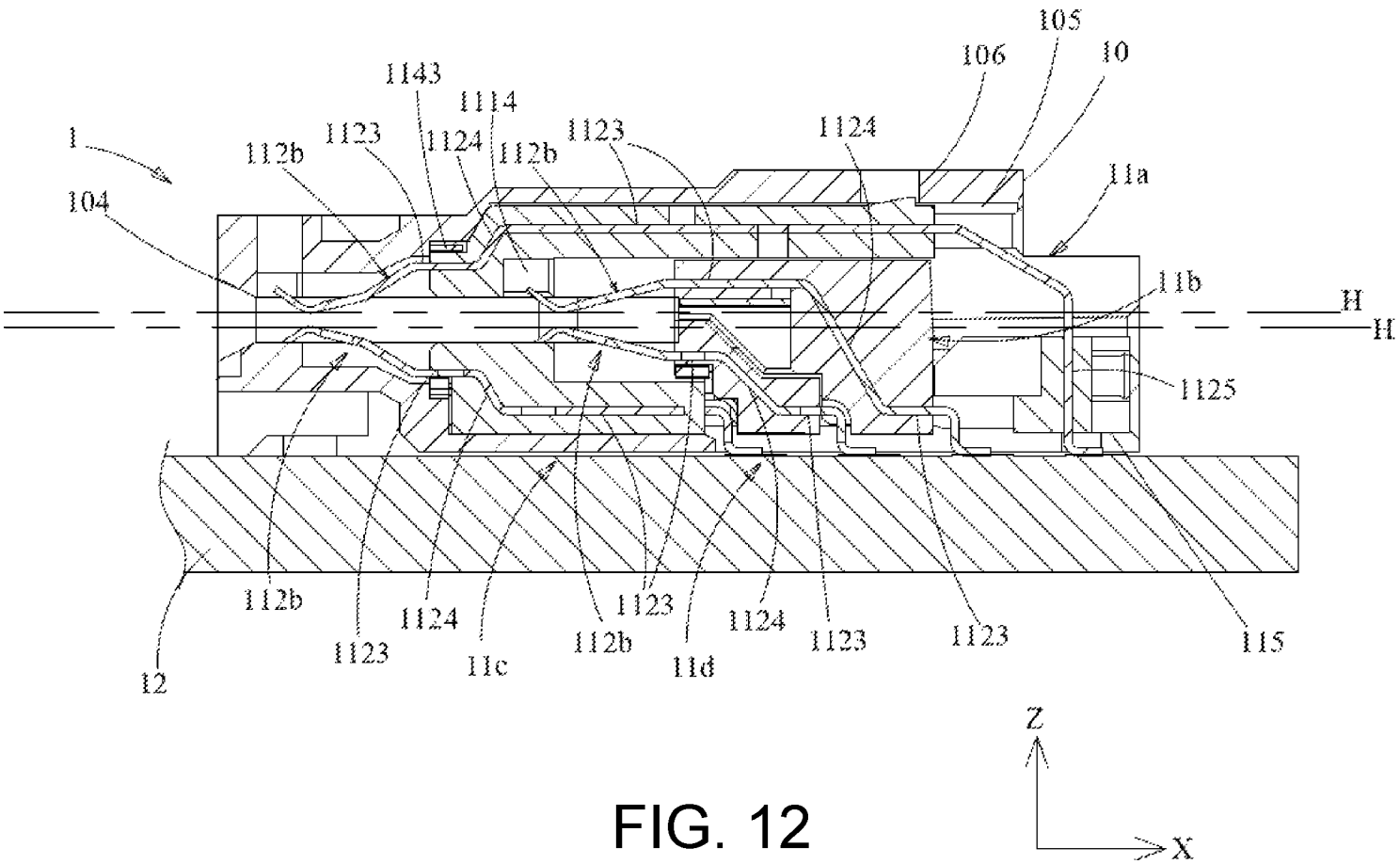
FIG. 12 is a cross-sectional view along line D-D' of FIG. 1.

FIG. 11 is a cross-sectional view along line C-C' of FIG. 1. FIG. 12 is a cross-sectional view along line D-D' of FIG. 1. As shown in the figures, the plurality of second ground terminals 113*b* respectively comprise a plurality of ground flat parts 1135 and at least one ground connecting part 1136. The plurality of ground flat parts 1135 are parallel to the horizontal plane H orthogonal to the first direction Z, where the heights of the plurality of ground flat parts 1135 and the height of the horizontal plane H are different. Two ends of the ground connecting part 1136 are respectively connected with two adjacent ground flat parts 1135. The ground connecting part 1136 is inclined to the horizontal plane H orthogonal to the first direction Z. In this embodiment, the number of ground flat parts 1135 is two, and the number of ground connecting parts 1136 is one. The plurality of first signal terminals 112*a* and the plurality of second signal terminals 112*b* respectively comprise a plurality of signal flat parts 1123 and at least one signal connecting part 1124. The plurality of signal flat parts 1123 are parallel to a horizontal plane orthogonal to the first direction Z, where the heights of the plurality of signal flat parts 1123 and the height of the horizontal plane are different. Two adjacent signal flat parts 1123 are interconnected through a signal connecting part 1124, which is inclined to the horizontal plane H orthogonal to the first direction Z. In this embodiment, the number of signal flat parts 1123 is two, and the number of signal connecting parts 1124 is one. In this embodiment, the signal flat parts 1123 of the plurality of first signal terminals 112*a* are respectively exposed from the first accommodating recess 1111, and the signal connecting parts 1124 of the plurality of first signal terminals 112*a* are respectively exposed from the third accommodating recess 1113. In this embodiment, the signal connecting parts 1124 of the plurality of first signal terminals 112*a* of the first lower terminal module 11*c* are further exposed from the second accommodating recess 1112, respectively.

The electromagnetic shielding member 114 comprises a plurality of shielding parts 1141 and a plurality of grounding parts 1142. The plurality of shielding parts 1141 are disposed at intervals. Two opposite sides of the shielding part 1141 respectively comprise a plurality of grounding parts 1142 in the second direction X. The plurality of grounding parts 1142 are disposed between two adjacent shielding parts 1141. Since the heights of the grounding parts 1142 and the heights of the shielding parts 1141 are different, the electromagnetic shielding member 114 would be configured in a zigzag pattern. The heights of the plurality of grounding parts 1142 disposed at one side of the shielding part 1141 in the second direction X are different from the plurality of grounding parts 1142 disposed at another side of the shielding part 1141 in the second direction X. In this embodiment, two opposite sides of the shielding part 1141 respectively comprises two grounding parts 1142 in the second direction X. Two grounding parts 1142 are disposed between two adjacent shielding parts 1141. The heights of the two grounding parts 1142 disposed at one side of the shielding part 1141 in the second direction X are different. When the electromagnetic shielding member 114 is disposed on a surface of the insulating body 111 in the first direction Z, the plurality of grounding parts 1142 disposed at one side of the shielding part 1141 are respectively in contact with the plurality of flat contacting parts 1133 of the corresponding first ground terminal 113*a*. The shielding part 1141 covers the signal flat parts 1123 and the signal connecting parts 1124 of the two first signal terminals 112*a* disposed between two adjacent first ground terminals 113*a* for shielding.

The shielding part 1141 comprises a plurality of flat shielding bodies 11411 and at least one connect shielding body 11412. The plurality of flat shielding bodies 11411 are respectively parallel to the horizontal plane H orthogonal to the first direction Z. The heights of the plurality of flat shielding bodies 11411 are different. Two adjacent flat shielding bodies 11411 are interconnected through the connect shielding body 11412. The connect shielding body 11412 is inclined to the horizontal plane H orthogonal to the first direction Z. Two opposite sides of each of the flat shielding bodies 11411 comprises a grounding part 1142 in the second direction X. In this embodiment, the number of flat shielding bodies 11411 is two, and the number of connect shielding bodies 11412 is one. Two ends of the connect shielding body 11412 are respectively connected with two flat shielding bodies 11411. When the electromagnetic shielding body 114 is disposed on the surface of the insulating body 111 in the first direction Z, two flat shielding bodies 11411 would respectively cover the signal flat parts 1123 of two first signal terminals 112*a* of two adjacent first ground terminals 113*a*, and the connect shielding body 11412 would cover the signal connecting parts 1124 of two first signal terminals 112*a* of two adjacent first ground terminals 113*a*.

In this embodiment, the electromagnetic shielding member 114 further comprises a connecting part 1143. Two ends of the connecting part 1143 are respectively connected with two opposite grounding parts 1142 close to the second signal terminal 112*b*. The height of the connecting part 1143 and the heights of the plurality of grounding parts 1142 are different. When the electromagnetic shielding member 114 is disposed on the surface of the insulating body 111 in the first direction Z, the connecting part 1143 would span across the ground flat parts 1135 of the corresponding plurality of second ground terminals 113*b* and the signal flat parts 1123 of the corresponding plurality of second signal terminals 112*b* (shown in FIG. 9 and FIG. 10). In other embodiments, the connecting part 1143 may not be connected with the two opposite grounding parts 1142 close to the second signal terminal 112*b*.

In this embodiment, the plurality of first signal terminals 112*a* are respectively processed through the plurality of signal flat parts 1123 and at least one signal connecting part 1124 to form a bent type signal terminal, and the plurality of first ground terminals 113*a* are respectively processed through the plurality of flat contacting parts 1133 and at least one inclined connecting part 1134 to form a bent type ground terminal. In this embodiment, since the plurality of grounding parts 1142 of the integratingly formed electromagnetic shielding member 114 are in multiple contact with one first ground terminal 113*a*, the plurality of shielding parts 1141 of the electromagnetic shielding member 114 cover the plurality of signal flat parts 1123 and at least one of the signal connecting parts 1124 of the plurality of first signal terminals 112*a*. In this way, covering the plurality of first signal terminals 112*a* with one electromagnetic shielding member 114 could reduce the overall manufacturing cost of the electrical connector 1, and with one electromagnetic shielding member 114 applied, which can be disposed along the contour of the terminal without increasing the size of the electrical connector 1, the area covering the plurality of first signal terminals 112*a* can be effectively increased, and the signal transmission performance of the electrical connector 1 can also be increased. Thus, the signal transmission performance of the electrical connector 1 can be effectively improved to a rate of 40 Gbps or even faster.

In other embodiments, two opposite sides of the connect shielding body 11412 of a plurality of shielding parts 1141 of an electromagnetic shielding member 114 can also be respectively provided with a grounding part 1142. The grounding part 1142 is in contact with an inclined connecting part 1134 of the corresponding first ground terminal 113*a*. In this way, the reduction of the opening of the electromagnetic shielding member 114 can be improved, the electromagnetic shielding effect of the electromagnetic shielding member 114 to the plurality of first signal terminals 112*a* can be effectively improved, and the signal transmission performance of the electrical connector 1 can also be greatly improved.

Figure 13:
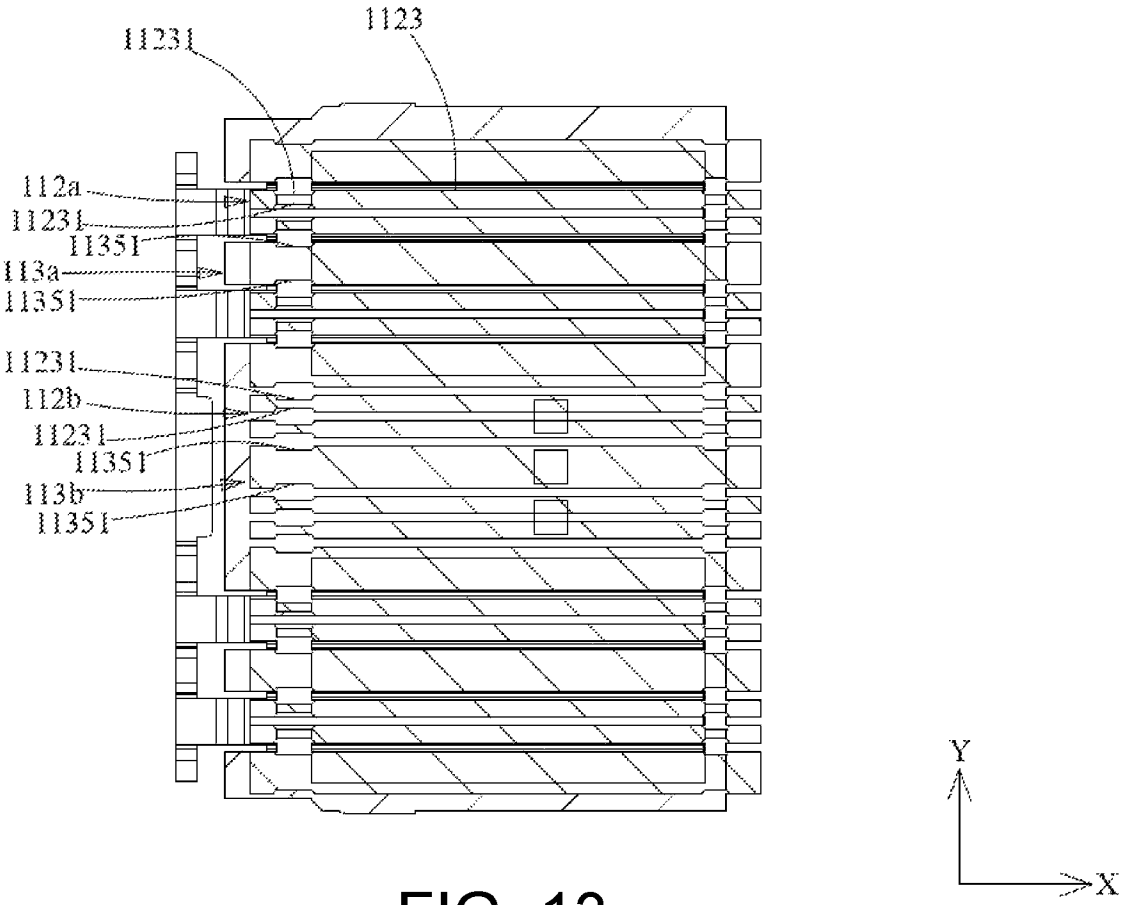
FIG. 13 is a cross-sectional view of the first upper terminal module of an embodiment of the present disclosure.
Figure 14:
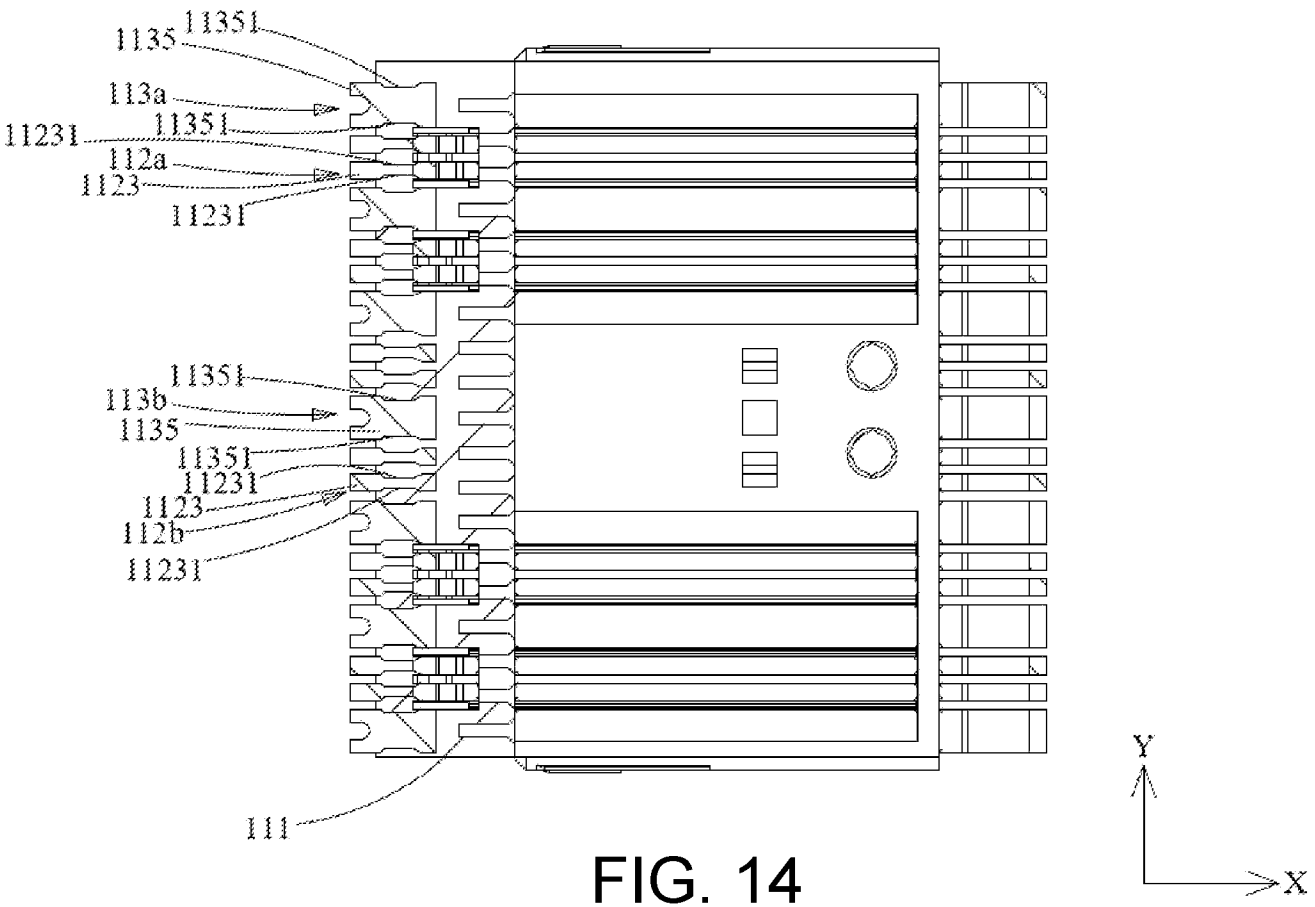
FIG. 14 is another cross-sectional view of the first upper terminal module of an embodiment of the present disclosure.

FIG. 13 and FIG. 14 are cross-sectional views of the first upper terminal module of an embodiment of the present disclosure. As shown in the figures, in this embodiment, two opposite side edges of the plurality of signal flat parts 1123 of the plurality of first signal terminals 112*a* and the plurality of second signal terminals 112*b* in the second direction X respectively comprise at least one signal retracting notch 11231.

Two opposite side edges of the plurality of flat contacting parts 1133 of the plurality of first ground terminals 113*a* in the second direction X and two opposite side edges of the plurality of ground flat parts 1135 of the plurality of second ground terminals 113*b* in the second direction X respectively comprise at least one ground retracting notch 11351. When the insulating body 111 is inject-molded at the plurality of signal terminals 112 and the plurality of ground terminals 113, the insulating body 111 would enter the signal retracting notches 11231 of the plurality of signal terminals 112 and the ground retracting notches 11351 of the plurality of ground terminals 113. In this way, the plurality of signal terminals 112 and the plurality of ground terminals 113 can be fixed to the insulating body 111.

In this embodiment, the width of the plurality of ground terminals 113 in the second direction X is configured to be wider than the width of the plurality of signal terminals 112 in the second direction X to increase the size of contacting areas between the plurality of grounding parts 1142 and the plurality of flat contacting parts 1133 of the plurality of first ground terminals 113*a*, respectively. In this way, the plurality of grounding parts 1142 can be firmly contacting with the plurality of flat contacting parts 1133 of the plurality of first ground terminals 113*a*, respectively. The plurality of first ground terminals 113*a* and the plurality of second ground terminals 113*b* respectively comprise a contacting end part 1137. One ends of the contacting end parts 1137 of the plurality of first ground terminals 113*a* are connected with the flat contacting part 1133 exposed from the second accommodating recess 1112. The other ends of the contacting end parts 1137 of the plurality of first ground terminals 113*a* extend in a direction away from the insulating body 111. One ends of the contacting end parts 1137 of the plurality of second ground terminals 113*b* are connected with the ground flat part 1135 close to the ground plugging end 1130. The other ends of the contacting end parts 1137 of the plurality of second ground terminals 113*b* extend in a direction away from the insulating body 111. The ground contacting bumps 1132 of the plurality of first ground terminals 113*a* and the plurality of second ground terminals 113*b* are respectively disposed at the corresponding contacting end parts 1137. The contacting end parts 1137 of the plurality of first ground terminals 113*a* and the plurality of second ground terminals 113*b* comprise an opening 11371. Thus, the flexibility of the contacting end parts 1137 of the plurality of first ground terminals 113*a* and the plurality of second ground terminals 113*b* can be increased to stabilize the connection between the contacting end parts 1137 of the plurality of first ground terminals 113*a* and the plurality of second ground terminals 113*b* and a mating connector.

In this embodiment, the length of the signal flat parts 1123 of the plurality of first signal terminals 112*a* of the first upper terminal module 11*a* exposed from the first accommodating recess 1111 in the third direction Y perpendicular to the first direction Z and the second direction X and the length of the flat contacting parts 1133 of the plurality of first ground terminals 113*a* of the first upper terminal module 11*a* exposed from the first accommodating recess 1111 in the third direction Y perpendicular to the first direction Z and the second direction X is greater than the length of the signal flat parts 1123 of the plurality of first signal terminals 112*a* of the first lower terminal module 11*c* exposed from the first accommodating recess 1111 in the third direction Y and the length of the flat contacting parts 1133 of the plurality of first ground terminals 113*a* of the first lower terminal module 11*c* exposed from the first accommodating recess 1111 in the third direction Y. The length of the shielding part 1141 of the electromagnetic shielding member 114 covering the signal flat part 1123 exposed from the first accommodating recess 1111 in the first upper terminal module 11*a* in the third direction Y is greater than the length of the shielding part 1141 of the electromagnetic shielding member 114 covering the signal flat part 1123 exposed from the first accommodating recess 1111 in the first lower terminal module 11*c* in the third direction Y. In other words, the length of the electromagnetic shielding member 114 of the first upper terminal module 11*a* in the third direction Y is greater than the length of the electromagnetic shielding member 114 of the first lower terminal module 11*c* in the third direction Y.

When the first upper terminal module 11*a*, the second upper terminal module 11*b*, the second lower terminal module 11*d*, and the first lower terminal module 11*c* are stacked, the third surface 111*d* of the insulating body 111 of the first upper terminal module 11*a* is adjacent to the third surface 111*d* of the insulating body 111 of the second upper terminal module 11*b*, the third surface 111*d* of the insulating body 111 of the first upper terminal module 11*a* is adjacent to the third surface 111*d* of the insulating body 111 of the second upper terminal module 11*b*, and the third surface 111*d* of the insulating body 111 of the first lower terminal module 11*c* is adjacent to the second surface 111*b* of the insulating body 111 of the second lower terminal module 11*d*. The insulating body 111 of the second lower terminal module 11*d* further comprises a fourth surface 111*e* and a second connecting surface 111*f* in the first direction Z. The fourth surface 111*e* is opposite to the second surface 111*b*, and the second connecting surface 111*f* is connected with the third surface 111*d* and the fourth surface 111*e*. The first surface 111*a* of the insulating body 111 of the second upper terminal module 11*b* is adjacent to the third surface 111*d* of the insulating body 111 of the second lower terminal module 11*d*. The second surface 111*b* of the insulating body 111 of the second upper terminal module 11*b* is adjacent to the fourth surface 111*e* of the insulating body 111 of the second lower terminal module 11*d*. The first connecting surface 111*c* of the insulating body 111 of the second upper terminal module 11*b* is adjacent to the second connecting surface 111*f* of the insulating body 111 of the second lower terminal module 11*d*.

The insulating bodies 111 of the first upper terminal module 11*a* and the first lower terminal module 11*c* further comprise a fifth surface 111*g* in the first direction Z. The fifth surface 111*g* is opposite to the second surface 111*b*. The fifth surface 111*g* comprises a plurality of terminal accommodating grooves 1114. The signal plugging ends 1120 of the plurality of signal terminals 112 and the ground plugging ends 1130 of the plurality of ground terminals 113 of the second upper terminal module 11*b* are respectively disposed in the plurality of terminal accommodating grooves 1114 of the first upper terminal module 11*a*. The signal plugging ends 1120 of the plurality of signal terminals 112 and the ground plugging ends 1130 of the plurality of ground terminals 113 of the second lower terminal module 11*d* are respectively disposed in the plurality of terminal accommodating grooves 1114 of the first lower terminal module 11*c*. In this way, the positions of the signal plugging ends 1120 of the plurality of signal terminals 112 and the ground plugging ends 1130 of the plurality of ground terminals 113 of the second upper terminal module 11*b* and the second lower terminal module 11*d* can be positioned.

In this embodiment, one ends of the plurality of signal terminals 112 of the first upper terminal module 11*a* close to the signal connecting end 1121 further comprises a signal vertical flat part 1125 parallel to the first direction Z, respectively. One ends of the plurality of ground terminals 113 of the first upper terminal module 11*a* close to the ground connecting end 1131 further comprises a ground vertical flat part 1138 parallel to the first direction Z, respectively. The first upper terminal module 11*a* further comprises a sub-insulating body 115 covering the signal vertical flat parts 1125 of the plurality of signal terminals 112 and the ground vertical flat parts 1138 of the plurality of ground terminals 113. The sub-insulating body 115 further comprises a hollow part 1151, from which the signal vertical flat parts 1125 of the plurality of first signal terminals 112*a* and the ground vertical flat parts 1138 of the plurality of first ground terminals 113*a* are respectively exposed. The first upper terminal module 11*a* further comprises a sub-electromagnetic shielding member 116. The sub-electromagnetic shielding member 116 is disposed in the hollow part 1151 and is in contact with the ground vertical flat parts 1138 of the plurality of first ground terminals 113*a*. In this embodiment, the number of hollow parts 1151 is multiple, to which the number of sub-electromagnetic shielding members 116 corresponds, which indicates that the number of sub-electromagnetic shielding members 116 is also multiple. Specifically, the sub-electromagnetic shielding member 116 comprises a plurality of sub-shielding parts 1161 and a plurality of sub-grounding parts 1162 which are alternately arranged. A gap exists between the plurality of sub-shielding parts 1161 and the plurality of sub-grounding parts 1162. When the sub-electromagnetic shielding members 116 are respectively disposed in the hollow part 1151, the plurality of sub-grounding parts 1162 would be respectively in contact with the ground vertical flat parts 1138 of the plurality of first ground terminals 113*a*. In this way, the electromagnetic shielding range can be increased to improve the signal transmission performance of the electrical connector 1.

Figure 15:
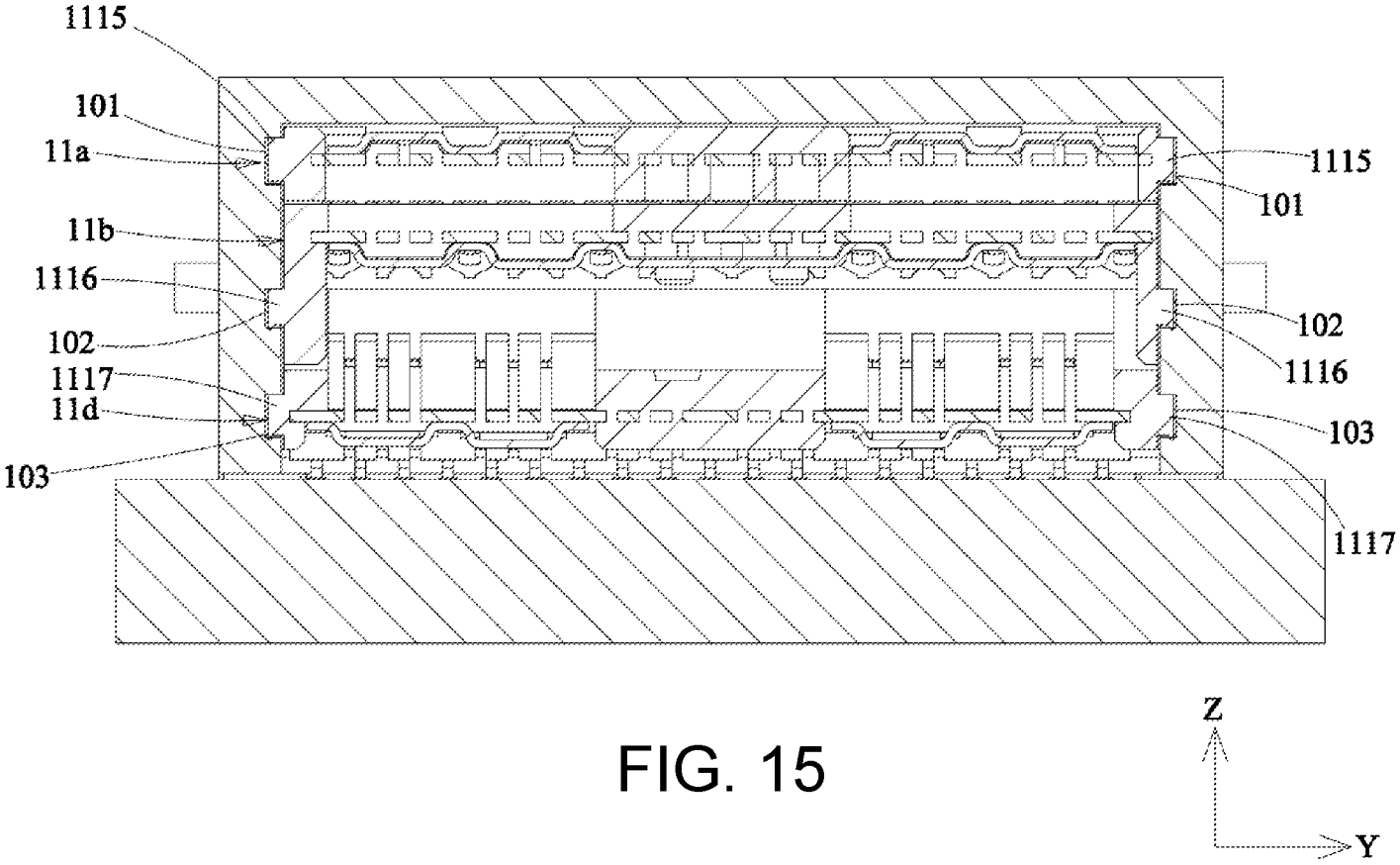
FIG. 15 is a cross-sectional view along line E-E' of FIG. 1.

FIG. 15 is a cross-sectional view along line E-E' of FIG. 1. As shown in the figure, in this embodiment, two opposite side edges of the insulating body 111 of the first upper terminal module 11*a* in the third direction Y respectively comprise a first guiding bump 1115. Two opposite side edges of the insulating body 111 of the second upper terminal module 11*b* and the second lower terminal module 11*d* in the third direction Y respectively comprise a second guiding bump 1116. The second guiding bump 1116 of the second upper terminal module 11*b* and the second guiding bump 1116 of the second lower terminal module 11*d* are arranged in a row, and the second guiding bump 1116 is disposed below the first guiding bump 1115. Two opposite side edges of the insulating body 111 of the first lower terminal module 11*c*, the second upper terminal module 11*b*, and the second lower terminal module 11*d* and the sub-insulating body 115 of the first upper terminal module 11*a* in the third direction respectively comprise a third guiding bump 1117. The third guiding bump 1117 of the first lower terminal module 11*c*, the third guiding bump 1117 of the second upper terminal module 11*b*, the third guiding bump 1117 of the second lower terminal module 11*d*, and the third guiding bump 1117 of the first upper terminal module 11*a* are arranged in a row. The third guiding bump 1117 is disposed below the second guiding bump 1116. Two opposite inner side surfaces of the housing 10 respectively comprise a first guiding groove 101, a second guiding groove 102, and a third guiding groove 103 in the third direction Y. In this embodiment, two opposite ends of the housing 10 respectively comprise a plugging opening 104 and an assembly opening 105 in the second direction X. The plugging opening 104 and the assembly opening 105 are in communication with the accommodating groove 100. The first guiding groove 101, the second guiding groove 102, and the third guiding groove 103 extend in a direction toward the plugging opening 104 from the assembly opening 105 along the second direction X. When the stacked first upper terminal module 11*a*, second upper terminal module 11*b*, second lower terminal module 11*d*, and first lower terminal module 11*c* enter the housing 10 through the assembly opening 105, the first guiding bump 1115 would enter the corresponding first guiding groove 101, the plurality of second guiding bumps 1116 arranged in a row would enter the corresponding second guiding groove 102, and the plurality of third guiding bumps 1117 arranged in a row would enter the corresponding third guiding groove 103. An end surface of the first guiding bump 1115 of the first upper terminal module 11*a* in the second direction X and close to the plugging opening 104 abuts against a sidewall of the first guiding groove 101 in the second direction X. An end surface of the second guiding bump 1116 of the second upper terminal module 11*b* in the second direction X and close to the plugging opening 104 abuts against a sidewall of the second guiding groove 102 in the second direction X. An end surface of the third guiding bump 1117 of the first lower terminal module 11*c* in the second direction X and close to the plugging opening 104 abuts against a sidewall of the third guiding groove 103 in the second direction X. In this way, the stacked first upper terminal module 11*a*, second upper terminal module 11*b*, second lower terminal module 11*d*, and first lower terminal module 11*c* can be prevented from being separated from the housing 10 from the plugging opening 104. When the stacked first upper terminal module 11*a*, second upper terminal module 11*b*, second lower terminal module 11*d*, and first lower terminal module 11*c* are assembled in the housing 10, the signal plugging ends 1120 of the plurality of signal terminals 112 and the ground plugging ends 1130 of the plurality of ground terminals 113 of the first upper terminal module 11*a*, the second upper terminal module 11*b*, the second lower terminal module 11*d*, and the first lower terminal module 11*c* are closer than the signal connecting end 1121 of the plurality of signal terminals 112 and the ground connecting end 1131 of the plurality of ground terminals 113 of the first upper terminal module 11*a*, the second upper terminal module 11*b*, the second lower terminal module 11*d*, and the first lower terminal module 11*c* to the plugging opening 104. The signal connecting ends 1121 of the plurality of signal terminals 112 and the ground connecting ends 1131 of the plurality of ground terminals 113 of the first upper terminal module 11*a*, the second upper terminal module 11*b*, the second lower terminal module 11*d*, and the first lower terminal module 11*c* are exposed from the assembly opening 105.

As shown in FIG. 1, FIG. 2, FIG. 3, FIG. 4, and FIG. 11, in this embodiment, two opposite sidewalls of the housing 10 respectively comprise a positioning through hole 106 in the first direction Z. A surface of the insulating body 111 of the first upper terminal module 11*a* in the first direction Z and away from the second upper terminal module 11*b* and a surface of the insulating body 111 of the first lower terminal module 11*c* in the first direction Z and away from the second lower terminal module 11*d* respectively comprise a positioning block 1119. When the stacked first upper terminal module 11*a*, second upper terminal module 11*b*, second lower terminal module 11*d*, and first lower terminal module 11*c* are assembled in the housing 10, the positioning block 1119 of the first upper terminal module 11*a* and the positioning block 1119 of the first lower terminal module 11*c* would be respectively disposed in the corresponding positioning through holes 106. A surface of the positioning block 1119 in the second direction X and away from the plugging opening 104 abuts against a sidewall of the positioning through hole 106 to prevent the stacked first upper terminal module 11*a*, second upper terminal module 11*b*, second lower terminal module 11*d*, and first lower terminal module 11*c* from being detached from the housing 10 from the assembly opening 105.

As shown in FIG. 1, FIG. 2, and FIG. 8 to FIG. 10, the electrical connector 1 further comprises a circuit board 12, which comprises a plurality of conductive pads. The signal connecting ends 1121 of the plurality of signal terminals 112 and the ground connecting ends 1131 of the plurality of ground terminals 113 of the first upper terminal module 11*a*, the second upper terminal module 11*b*, the first lower terminal module 11*c*, and the second lower terminal module 11*d* of the electrical connector 1 are respectively connected with the plurality of conductive pads of the circuit board 12. In this embodiment, a surface of the housing 10 in the first direction Z and close to the circuit board 12 comprises a positioning column 107 (shown in FIG. 4). The circuit board 12 comprises a positioning hole corresponding to the positioning column 107 (not shown). When the housing 10 accommodating the first upper terminal module 11*a*, the second upper terminal module 11*b*, the first lower terminal module 11*c*, and the second lower terminal module 11*d* is disposed on the circuit board 12, the positioning column 107 would be disposed in the positioning hole to position the housing 10 on the circuit board 12 to ensure that the signal connecting ends 1121 of the plurality of signal terminals 112 and the ground connecting ends 1131 of the plurality of ground terminals 113 of the first upper terminal module 11*a*, the second upper terminal module 11*b*, the first lower terminal module 11*c*, and the second lower terminal module 11*d* of the electrical connector 1 can be accurately connected to the plurality of conductive pads of the circuit board 12, respectively.

The mating connector connected with the electrical connector 1 of this embodiment comprises a tongue plate, which comprises a plurality of electrical connecting pads. The signal contacting bumps 1122 of the plurality of signal terminals 112 and the ground contacting bumps 1132 of the plurality of ground terminals 113 of the first upper terminal module 11*a*, the second upper terminal module 11*b*, the first lower terminal module 11*c*, and the second lower terminal module 11*d* of the electrical connector 1 are respectively in contact with the plurality of electrical connecting pads of the tongue plate for signal transmission.

In summary, embodiments of the present disclosure provide an electrical connector. An electromagnetic shielding member is configured to multiple contact with one ground terminal, so that the electromagnetic shielding member can be disposed along the contour of a bent terminal. In this way, not only the overall manufacturing cost can be reduced, but the size of the electrical connector would not be increased, and the area of the electromagnetic shielding member covering the plurality of first (high speed) signal terminals can further be increased. Thus, the signal transmission performance of the electrical connector can be effectively improved to a rate of 40 Gbps or even faster.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a housing comprising an accommodating groove;

a first upper terminal module disposed in the accommodating groove;

a second upper terminal module disposed in the accommodating groove, the second upper terminal module being disposed at one side of the first upper terminal module;

a first lower terminal module disposed in the accommodating groove, the first lower terminal module being disposed at one side of the second upper terminal module; and a second lower terminal module disposed in the accommodating groove, the second lower terminal module being disposed between the first lower terminal module and the second upper terminal module, the first upper terminal module, the second upper terminal module, the first lower terminal module, and the second lower terminal module being stacked along a first direction;

wherein the first upper terminal module, the second upper terminal module, the first lower terminal module, and the second lower terminal module respectively comprise an insulating body, a plurality of signal terminals, a plurality of ground terminals, and an electromagnetic shielding member; the plurality of signal terminals and the plurality of ground terminals are disposed in the insulating body; at least one of the signal terminals is disposed between two adjacent ground terminals; the plurality of signal terminals comprise a plurality of first signal terminals; the plurality of ground terminals comprise a plurality of first ground terminals; the plurality of first ground terminals respectively comprise a plurality of flat contacting parts exposed from the insulating body; the heights of the plurality of flat contacting parts on respective ground terminals are different; the electromagnetic shielding member is disposed on a surface of the insulating body in the first direction; the electromagnetic shielding member comprises a plurality of shielding parts and a plurality of grounding parts; two opposite sides of the plurality of shielding parts respectively comprise the plurality of grounding parts; the plurality of grounding parts are respectively in contact with the plurality of flat contacting parts of the corresponding first ground terminal; the plurality of shielding parts respectively cover a part of the plurality of first signal terminals.

2. The electrical connector according to claim 1, wherein the plurality of flat contacting parts are parallel to a horizontal plane orthogonal to the first direction.

3. The electrical connector according to claim 1, wherein a width of the plurality of ground terminals in the second direction is wider than a width of the plurality of signal terminals in the second direction.

4. The electrical connector according to claim 1, wherein the plurality of signal terminals respectively comprise a signal plugging end and a signal connecting end; the plurality of ground terminals respectively comprise a ground plugging end and a ground connecting end; the signal plugging ends and the signal connecting ends of the plurality of signal terminals and the ground plugging ends and the ground connecting ends of the plurality of ground terminals respectively protrude from the insulating body.

5. The electrical connector according to claim 4, wherein the signal plugging ends of the plurality of signal terminals and the ground plugging ends of the plurality of ground terminals of the first upper terminal module are farther than the signal plugging ends of the plurality of signal terminals and the ground plugging ends of the plurality of ground terminals of the second upper terminal module away from the insulating body of the second upper terminal module; the signal plugging ends of the plurality of signal terminals and the ground plugging ends of the plurality of ground terminals of the first lower terminal module are farther than the signal plugging ends of the plurality of signal terminals and the ground plugging ends of the plurality of ground terminals of the second lower terminal module away from the insulating body of the second lower terminal module.

6. The electrical connector according to claim 4, wherein the signal plugging ends of the plurality of signal terminals of the first upper terminal module are opposite to the signal plugging ends of the plurality of signal terminals of the first lower terminal module; the ground plugging ends of the plurality of ground terminals of the first upper terminal module are opposite to the ground plugging ends of the plurality of ground terminals of the first lower terminal module; the signal plugging ends of the plurality of signal terminals of the second upper terminal module are opposite to the signal plugging ends of the plurality of signal terminals of the second lower terminal module; the ground plugging ends of the plurality of ground terminals of the second upper terminal module are opposite to the ground plugging ends of the plurality of ground terminals of the second lower terminal module.

7. The electrical connector according to claim 4, wherein the signal connecting ends of the plurality of signal terminals of the first upper terminal module are farther than the signal connecting ends of the plurality of signal terminals of the second upper terminal module away from the insulating body of the second upper terminal module; the signal connecting ends of the plurality of signal terminals of the second upper terminal module are farther than the signal connecting ends of the plurality of signal terminals of the second lower terminal module away from the insulating body of the second lower terminal module; the signal connecting ends of the plurality of signal terminals of the second lower terminal module are farther than the signal connecting ends of the plurality of signal terminals of the first lower terminal module away from the insulating body of the first lower terminal module; the ground connecting ends of the plurality of ground terminals of the first upper terminal module are farther than the ground connecting ends of the plurality of ground terminals of the second upper terminal module away from the insulating body of the second upper terminal module; the ground connecting ends of the plurality of ground terminals of the second upper terminal module are farther than the ground connecting ends of the plurality of ground terminals of the second lower terminal module away from the insulating body of the second lower terminal module; the ground connecting ends of the plurality of ground terminals of the second lower terminal module are farther than the ground connecting ends of the plurality of ground terminals of the first lower terminal module away from the insulating body of the first lower terminal module.

8. The electrical connector according to claim 4, wherein the signal plugging ends of the plurality of signal terminals respectively comprise a signal contacting bump; the ground plugging ends of the plurality of ground terminals respectively comprise a ground contacting bump; the protruding direction of the signal contacting bumps of the plurality of signal terminals and the ground contacting bumps of the plurality of ground terminals of the first upper terminal module and the second upper terminal module are opposite to the protruding direction of the signal contacting bumps of the plurality of signal terminals and the ground contacting bumps of the plurality of ground terminals of the first lower terminal module and the second lower terminal module and the protruding direction of the signal contacting bumps of the plurality of signal terminals and the ground contacting bumps of the plurality of ground terminals of the second lower terminal module.

9. The electrical connector according to claim 8, wherein the signal contacting bumps of the plurality of signal terminals of the first upper terminal module and the signal contacting bumps of the plurality of signal terminals of the second upper terminal module are disposed on a horizontal plane orthogonal to the first direction; the ground contacting bumps of the plurality of ground terminals of the first upper terminal module and the ground contacting bumps of the plurality of ground terminals of the second upper terminal module are disposed on a horizontal plane orthogonal to the first direction.

10. The electrical connector according to claim 8, wherein the signal contacting bumps of the plurality of signal terminals of the first lower terminal module and the signal contacting bumps of the plurality of signal terminals of the second lower terminal module are disposed on a horizontal plane orthogonal to the first direction; the ground contacting bumps of the plurality of ground terminals of the first lower terminal module and the ground contacting bumps of the plurality of ground terminals of the second lower terminal module are disposed on a horizontal plane orthogonal to the first direction.

11. The electrical connector according to claim 4, wherein one ends of the plurality of signal terminals of the first upper terminal module close to the signal connecting end respectively comprise a signal vertical flat part parallel to the first direction; one ends of the plurality of ground terminals of the first upper terminal module close to the ground connecting end respectively comprise a ground vertical flat part parallel to the first direction; the first upper terminal module comprises a sub-insulating body; the sub-insulating body covers the signal vertical flat parts of the plurality of signal terminals and the ground vertical flat parts of the plurality of ground terminals; the sub-insulating body comprises a hollow part; the signal vertical flat parts of the plurality of first signal terminals and the ground vertical flat parts of the plurality of first ground terminals are respectively exposed from the hollow part; the first upper terminal module comprises a sub-electromagnetic shielding member; the sub-electromagnetic shielding member is disposed in the hollow part and is in contact with the ground vertical flat parts of the plurality of first ground terminals.

12. The electrical connector according to claim 4, wherein the insulating body comprises a plurality of first accommodating recesses and a plurality of second accommodating recesses respectively formed on a first surface and a second surface of the insulating body in the first direction; the first surface is parallel to the second surface; the plurality of flat contacting parts are respectively exposed from the plurality of first accommodating recesses and the plurality of second accommodating recesses.

13. The electrical connector according to claim 12, wherein the insulating body comprises a plurality of third accommodating recesses; the plurality of third accommodating recesses form a first connecting surface between the first surface and the second surface; the plurality of first ground terminals respectively comprise an inclined connecting part; two ends of the inclined connecting part are respectively connected with two adjacent flat contacting parts; the inclined connecting part is exposed from the corresponding third accommodating recess.

14. The electrical connector according to claim 13, wherein the plurality of ground terminals comprise a plurality of second ground terminals; the plurality of second ground terminals respectively comprise a plurality of ground flat parts and at least one ground connecting part; the plurality of ground flat parts are parallel to a horizontal plane orthogonal to the first direction with a height difference therebetween; two ends of the at least one ground connecting part are respectively connected with two adjacent ground flat parts; the at least one ground connecting part is inclined to the horizontal plane orthogonal to the first direction; the plurality of signal terminals comprise a plurality of second signal terminals; the plurality of first signal terminals and the plurality of second signal terminals respectively comprise a plurality of signal flat parts and at least one signal connecting part; the plurality of signal flat parts are parallel to the horizontal plane orthogonal to the first direction with a height difference therebetween; two ends of the at least one signal connecting part are respectively connected with two adjacent signal flat parts; the at least one signal connecting part is respectively inclined to the horizontal plane orthogonal to the first direction; the plurality of signal flat parts of the plurality of first signal terminals are respectively exposed from the corresponding first accommodating recess; the at least one signal connecting part of the plurality of first signal terminals is exposed from the corresponding third accommodating recess.

15. The electrical connector according to claim 14, wherein the at least one signal connecting part of the plurality of first signal terminals of the first lower terminal module is exposed from the corresponding second accommodating recess.

16. The electrical connector according to claim 14, wherein the heights of the plurality of grounding parts and the heights of the plurality of shielding parts are different.

17. The electrical connector according to claim 14, wherein the plurality of shielding parts respectively cover the plurality of signal flat parts and the at least one signal connecting part of at least one of the first signal terminals disposed between two adjacent first ground terminals.

18. The electrical connector according to claim 17, wherein the plurality of shielding parts respectively comprise a plurality of flat shielding bodies and at least one connect shielding body; the plurality of flat shielding bodies are respectively parallel to the horizontal plane orthogonal to the first direction; the heights of the plurality of flat shielding bodies of respective shielding parts are different; two adjacent flat shielding bodies are connected through the connect shielding body, the at least one connect shielding body is inclined to the horizontal plane; two opposite sides of each of the plurality of flat shielding bodies in a second direction respectively comprise one grounding part; the plurality of flat shielding bodies respectively cover at least one of the first signal terminals disposed in a part of two adjacent first ground terminals; the at least one connect shielding body covers the at least one first signal terminal disposed at a part of the two adjacent first ground terminals.

19. The electrical connector according to claim 18, wherein the plurality of first signal terminals and the plurality of second signal terminals respectively comprise a plurality of signal flat parts and at least one signal connecting part; the plurality of flat shielding bodies respectively cover the plurality of signal flat parts of the at least one first signal terminal of the two adjacent first ground terminals; the at least one connect shielding body covers the at least one signal connecting part of the at least one first signal terminal disposed at a part of the two adjacent first ground terminals.

20. The electrical connector according to claim 19, wherein the electromagnetic shielding member comprises a connecting part; the height of the connecting part and the height of the plurality of grounding parts are different; the connecting part spans across the plurality of ground flat parts of the corresponding plurality of second ground terminals and the at least one signal flat part of the corresponding plurality of second signal terminals.

21. The electrical connector according to claim 20, wherein two ends of the connecting part are respectively connected with two opposite grounding parts which are close to the second signal terminal.

22. The electrical connector according to claim 14, wherein two opposite sides of the plurality of signal flat parts of the plurality of first signal terminals and the plurality of second signal terminals in the second direction respectively comprise at least one signal retracting notch; two opposite sides of the plurality of flat contacting parts of the plurality of first ground terminals and the plurality of ground flat parts of the plurality of second ground terminals in the second direction respectively comprise at least one ground retracting notch.

23. The electrical connector according to claim 15, wherein the plurality of first ground terminals and the plurality of second ground terminals respectively comprise a contacting end part; one ends of the contacting end parts of the plurality of first ground terminals are respectively connected with the plurality of flat contacting parts exposed from the plurality of second accommodating recesses; one ends of the contacting end parts of the plurality of second ground terminals are respectively connected with the plurality of ground flat parts close to the ground plugging end; the contacting end part comprises an opening.

24. The electrical connector according to claim 22, wherein the length of the plurality of shielding parts of the electromagnetic shielding member covering the plurality of signal flat parts exposed from the plurality of first accommodating recesses in the first upper terminal module in the third direction orthogonal to the first direction and the second direction is greater than the length of the plurality of shielding parts of the electromagnetic shielding member covering the plurality of signal flat parts exposed from the plurality of first accommodating recesses in the first lower terminal module in the third direction.

25. The electrical connector according to claim 13, wherein the plurality of first accommodating recesses penetrate through a third surface of the insulating body in the first direction and opposite to the first surface; the third surface of the insulating body of the first upper terminal module is adjacent to the third surface of the insulating body of the second upper terminal module; the third surface of the insulating body of the first lower terminal module is adjacent to the second surface of the insulating body of the second lower terminal module.

26. The electrical connector according to claim 25, wherein the insulating body of the second lower terminal module comprises a fourth surface and a second connecting surface in the first direction; the fourth surface is opposite to the second surface; the second connecting surface is connected with the third surface and the fourth surface; the first surface of the insulating body of the second upper terminal module is adjacent to the third surface of the insulating body of the second lower terminal module; the second surface of the insulating body of the second upper terminal module is adjacent to the fourth surface of the insulating body of the second lower terminal module; the first connecting surface of the insulating body of the second upper terminal module is adjacent to the second connecting surface of the insulating body of the second lower terminal module.

27. The electrical connector according to claim 25, wherein the insulating body of the first upper terminal module and the first lower terminal module further comprise a fifth surface in the first direction; The fifth surface is opposite to the second surface; The fifth surface comprises a plurality of terminal accommodating grooves; the signal plugging ends of the plurality of signal terminals and the ground plugging ends of the plurality of ground terminals of the second upper terminal module are respectively disposed in the plurality of terminal accommodating grooves of the first upper terminal module; the signal plugging ends of the plurality of signal terminals and the ground plugging ends of the plurality of ground terminals of the second lower terminal module are respectively disposed in the plurality of terminal accommodating grooves of the first lower terminal module.

* * * * *